US005302148A

United States Patent [19]

Heinz

[11] Patent Number: 5,302,148

[45] Date of Patent: Apr. 12, 1994

[54] ROTATABLE DEMOUNTABLE BLOCKS OF SEVERAL SHAPES ON A CENTRAL ELASTIC ANCHOR

[76] Inventor: Ted Heinz, 33694 Colgate Dr., Union City, Calif. 94587

[21] Appl. No.: 746,245

[22] Filed: Aug. 16, 1991

[51] Int. Cl.[5] ..... A63H 33/10; A63H 33/00; A63F 9/06; G06C 1/00

[52] U.S. Cl. ..... 446/119; 446/486; 446/490; 273/153 S; 273/159; 434/204

[58] Field of Search ..... 446/119, 118, 85, 122, 446/486, 487, 489, 490; 273/153 R, 153 S, 156, 158, 159, 160; 434/203, 204, 208, 188, 215; 52/DIG. 10

[56] References Cited

U.S. PATENT DOCUMENTS

| | | | |
|---|---|---|---|
| 2,052,848 | 9/1936 | Schilling | 273/153 S |
| 2,825,178 | 3/1958 | Hawkins | 446/119 |
| 2,877,506 | 3/1959 | Almoslino | 446/122 X |
| 3,201,894 | 8/1965 | Resch | 273/153 R |
| 3,205,611 | 9/1965 | Onanian | 446/119 X |
| 3,577,673 | 5/1971 | Monestier | 446/490 |
| 3,745,694 | 7/1973 | Vennola | 446/119 X |
| 4,021,939 | 5/1977 | May | 446/118 X |
| 4,488,373 | 12/1984 | Glickson et al. | 446/490 X |
| 4,699,602 | 10/1987 | Giorgi | 446/490 X |
| 4,804,350 | 2/1989 | Chen | 446/120 X |
| 4,875,681 | 10/1989 | Ofir | 446/119 X |
| 4,997,375 | 3/1991 | Heinz | 446/487 X |
| 5,108,100 | 4/1992 | Essebaggers et al. | 446/487 X |

*Primary Examiner*—David N. Muir
*Attorney, Agent, or Firm*—Paul F. Schenck

[57] ABSTRACT

An educational toy that lets the user experiment with assembling components of different shapes in a variety of ways. The toy introduces new methods and means for assembling building blocks allowing the user to assemble them to one configuration and then to change over to other configurations by rotating, pivoting, rolling, or shifting one or more of the already assembled building blocks. The toy can introduce the user to number systems and arithmetic and geometric principles.

23 Claims, 16 Drawing Sheets

ROTATABLE DEMOUNTABLE BLOCKS OF SEVERAL SHAPES ON A CENTRAL ELASTIC ANCHOR

BACKGROUND OF THE INVENTION

The present invention relates to an educational toy that lets the user experiment with assembling components of different shapes in many different ways. The toy of the present invention introduces new methods and means for assembling building blocks. It allows to assemble building blocks to one configuration and then to change over to another configuration or shape by rotating, pivoting, rolling, or shifting one or more of the already assembled building blocks.

There are existent several toys incorporating flexible semirigid articulation of solid shapes in series. The following have concepts or capabilities related to the present invention:

U.S. Pat. No. 1,201,710 (FINCH): a toy set with a large diversity of different shaped grooved blocks held in fixed positions against each other by elastic bands to form figures.

U.S. Pat. No. 3,222,072 (DREYER): a manipulative puzzle. It is a set of 27 cubic blocks fixed in sequence on an elastic cord. The preferred figure or arrangement of the blocks is a cube.

U.S. Pat. No. 3,597,872 (YENNOLA): a manipulative toy of 16 cylindrical blocks fixed in sequence on an elastic cord. The blocks can be rotated relative to each other to form different figures.

U.S. Pat. No. 4,466,799 (ARGIRO): an instructional manipulative device for multiplication computation. It is a set of 81 sequentially numbered blocks forming a number line which may be folded between any block. It is designed for use on a flat surface.

U.S. Pat. No. 3,514,893 (PAKSY): a manipulative toy in which a flat series of polygons linked by spring mechanisms allows to form new formations by rolling and shifting adjacent polygons.

U.S. Pat. No. 4,484,406 (MATSUMOTO): a manipulative toy and puzzle using 24 triangular prism blocks fixed in sequence with mechanisms between adjacent blocks which allow to rotate blocks relative to adjacent blocks.

U.S. Pat. No. 2,825,178 (HAWKINS): A manipulative toy with a variable number of rectangular blocks fixed in sequence on an elastic cord.

U.S. Pat. No. 3,577,673 (MONESTIER): a manipulative toy with a variable number of cubic blocks in fixed sequence arranged on an elastic cord.

U.S. Pat. No. 4,997,375 (HEINZ): an open ended manipulative and educational device with symmetrical polyhedron blocks threaded on an elastic cord.

Educational Objectives and Advantages

One of the preferred objectives of the present invention is to provide a flexible educational resource, a manipulative which can serve a number of educational and developmental processes. More specifically: to provide an open-ended educational/developmental manipulative for mathematical concept learning, eye hand (perceptual-motor) development, systematic thinking, creative play as well as open-ended construction and entertainment with transformable spatial designs.

The users learn, teach or simply relax by assembling unique sets which they use to create and transform numeric patterns, geometric and aesthetic spatial designs, or symbolic figures. Affective involvement opens up further possibilities for broader social/language, creativity and language development.

Most prior art spatial design toys have a predetermined set of elements and as a result, a predetermined set of possible configurations. The present invention provides the means for the users to create their own transformable formations. They are free to use a unique set of blocks organized according to their own particular purpose.

While conserving the ordinary attribute or building block that is, the individual pieces can be stacked or laid out to form designs or constructions upon flat surfaces), the pieces can also be organized and threaded (much as one would thread beads) on an elastic strand. Then, as tension is applied, the blocks are held together along the length of the strand, and it becomes a semi-plastic medium for exploring a great variety of transformable two and three dimensional configurations according to the interests of the user.

While the open-ended possibilites are fundamental, this does not exclude its use for closed ended activities. It is expected that adults will often determine that some particular concept (or other learning need) will be served by a certain set or arrangement of blocks. To this end, they will prearrange sets of blocks and direct a sequence of activites appropriate for the particular needs of the learners.

The following are some of the important areas of learning for which the present invention may serve as an improvement resource: Manual dexterity, various aspects of language and thought development (colors, spatial relationships, sequence, planning, predicting, etc.), mathematics (counting, conservation of value, base 10 and other base systems, addition and subtraction, multiplication and division, two and three dimensional geometric principles, volume, cubic number, etc.).

Along with all the above, the affective dimension is very important. Children tend to see symbolic figures in any of the shapes and designs that can be created by this device. This not only stimulates their imagination and creative capacity but often is what integrates the more acedemic kind of learning into their personalities and intelligence. FIGS. 1 through 4 have been included to show in a minimal way the educational applications of this device.

Obviously, elements of this invention can be applied to fixed assembly transformable figures. Some things that come to mind: transformable logos, signs or messages that can be changed, doll joints, novelty toys, worry beads, etc.

Certainly puzzles can be created, with certain configurations as the solution. Table games could be developed where the moves are step by step changes in the interfaces, moving toward a configuration which achieves a goal.

Combined with non-elastic cord, rope or cable, and a means for taking up and letting out slack (tightening and loosening tension), this invention could have applications in diverse kinds of strong temporary, semi permanent, or even permanent constructions (toy or otherwise).

A form of this invention might be used as a highly adjustable arm, such as on a robot or for a lamp (to precisely position and direct the light).

The interlocking patterns on identical interfaces and the identical half shells for side threading could have applications in stacking containers or other items which need to be precisely aligned, or for snaps, and any other opposing element that normally are either female or male.

DESCRIPTION OF THE INVENTION

The present invention is an open ended manipulative and educational device. It achieves a much broader range of capabilities than all the prior art. The objectives of the present invention are:

Simple and generalized principles for keeping the threading cord on a common central axis.

Achieve stability between adjacent building blocks, as well as in the total assembly of building blocks.

Maintain and improve the ease of threading and cord binding.

Provide more ways of threading and more ways to combine sets of building blocks, add flexibility and efficiency.

Keep cord ends hidden, yet accessible, thus adding aesthetic appeal and facilitating the more adequate formation of certain configurations.

The use of identical matching elements on interlocking pieces avoids the distraction of having to discern which elements correctly match each other.

Improve perceptibility of the structures and mechanisms which encourages active thinking and understanding while successfully manipulating the device.

The most significant and overriding innovation in the present invention is the use of the hollow shell. The hollow shell offers several advantages for the use and functioning of this educational device. It enables the user to understand the simple principles of maintaining common central axis orientation:

a) The surface slot and endings afford the essential structure, not as deep a slot as in prior art.

b) For longer slots that traverse an entire side, a centering guide is necessary. The center guide may be located on the opposing surface or in the center of the block.

Specific Features of the Invention

1: Identify and clarify principles for keeping the threading cord on central axis. This allows manufacturers to produce new type of building blocks according to requests from educators.

The hollow shell helps to highlight these principles.

2: Stability of the configuration prevents individual building blocks from slipping and rotating relative to an adjacent building block. Stability is achieved by use of light weight hollow shell and building blocks with interlocking features.

3: The features 'flexibility' and 'ease of use' relate to:

a) ease of threading by use of smaller end sections at the end of the elastic cord and the width of the slots for threading the cord in the building blocks;

b) ease of cord binding by providing multiple choices for terminating an elastic cord in or at a terminating building block using a cross piece terminator or a binding narrow slot of a building block;

c) hiding cord ends; and d) combination of multi threading and cord termination.

Cord ends are hidden by terminating the end of an elastic cord inside the building block and where it does not interfere with other adjacent building blocks of a configuration of building blocks. Narrow binding slots inside certain building blocks and cords with notched ends provide for this feature. Cross piece terminators can be used with building blocks having no narrow slot facility.

A suitably formed cord end allows to thread the cord through holes containing already another cord. Side threading allows combination of independent assemblies of building into one new configuration of building blocks. Terminating cross pieces and narrow slots allow to terminate more than one cord in the same building block.

The side threading feature allows to insert a side threading building block into an existing assembly of building blocks without disassembly.

Multiple component building blocks consist of identical elements with identical interlock mechanisms to avoid confusion and distraction with which part is to fit into which other part.

4: Easy perceptibility of structure and mechanisms. Active thinking and understanding is encouraged during manipulation of the device because of hollow shells, transparent material, open sided building blocks, limited multiple slots in the same plane, and side threading.

The educational toy of the present invention includes a number of different building blocks which can be threaded on elastic cords to form two or three dimensional configurations. As soon as tension is applied to the elastic cord, the building blocks are held together in a selected configuration. The building blocks are polyhedrons of several different types. Each of the different types of building blocks has a distinct shape and means for interfacing with the elastic cord and for interfacing with adjacent building blocks. Building blocks are selected according to the configurations the user wants to implement and according to the desired interface of adjacent building blocks.

The building blocks are hollow bodies made from light weight material to keep the total weight of an assembly of blocks on an elastic cord as low as possible. It has been found, that with the weight of the individual building block assembled on a cord, the tension necessary to maintain a desired configuration has to be increased to prevent individual building blocks from changing their positional relationship with an adjacent building block. The building blocks of the present invention incorporate a number of features which improve maintainability of a desired configuration of building blocks.

The Description of the Preferred Embodiment includes descriptions of various major building blocks, building block assemblies, building block interfaces, the cords used to assemble building blocks to configurations, and methods and means for terminating the threading cords. The way and manner of assembling and modifying building block configurations is discussed with the various types of building blocks.

In the description of the building blocks the following definitions are used: While the expression polyhedron relates to solids bounded entirely by planes, in the context of this description hollow bodies with opposing open sides (called cookie cutters) are also included in the term polyhedron. The polygons that bound a polyhedron are called faces; the segments in which two faces come together are called edges; the end-points of edges are called vertices; the angle between two half-planes that meet at an edge is the face-angle between the two faces.

In principle all building blocks of the present invention have slots for guiding the elastic cord which is threaded through the building blocks. In some of the building blocks the arrangement of slots determines the common axis of adjacent building blocks. Other building blocks include separate means to establish a common axis of adjacent building blocks.

The following definitions relate to the description of the building blocks and the assembly of multiple building blocks and the transformation of the interface of adjacent building blocks.

| | |
|---|---|
| Configuration | two or three dimensional transformable assembly of building blocks. |
| Transform | to change a configuration of building blocks without disassembling. |
| Central common axis | axis connecting the centers of two adjacent building blocks. |
| Polyhedron shell | a three dimensional building block having at least three circumferential planes. |
| Slot | An elongated opening in the surface of a building block extending over at least two adjacent faces. |
| roll | changing the relative position of adjacent building blocks by rolling a building blocks around a common edge with an adjacent building block so that the two building blocks interface with their respective faces on the other side of the edge. |
| pivot | changing the relative position of adjacent building blocks by rotating a building block around an axis perpendicular to the common axis with an adjacent building block for changing the interfacing face of the rotated building block. |
| shift | changing the relative position of adjacent building blocks by moving one building block in such a manner that the orientation of the building block is not changed but the interfacing faces of two adjacent building blocks are changed. |
| rotate | changing the relative position of adjacent building blocks by rotating one building block around the common axis with the adjacent building block but maintaining the same interfacing faces. |
| Side threading | 1) a method of adding a building block to existing configuration of threaded building blocks by expanding the threading cord and sliding a building block with its slot over the exposed threading cord; 2) method of assembly in which first base components of multi-component building blocks are placed side-by side, the elastic cord is routed along the sequence of building blocks stretched and secured, and finally the remaining components of the building blocks are united with the base components. |
| Cord binding | a method of terminating the elastic cord at a building block. |
| Side intertion | A method for linking two assemblies of building block, where the cord of one assembly is stretched between two building blocks to receive a building block of the second assembly; the building block of the second assembly has to have a suitable slot into which the stretched cord of the first assembly can be slid. |

SHORT DESCRIPTION OF THE FIGURES

Figure 5A:
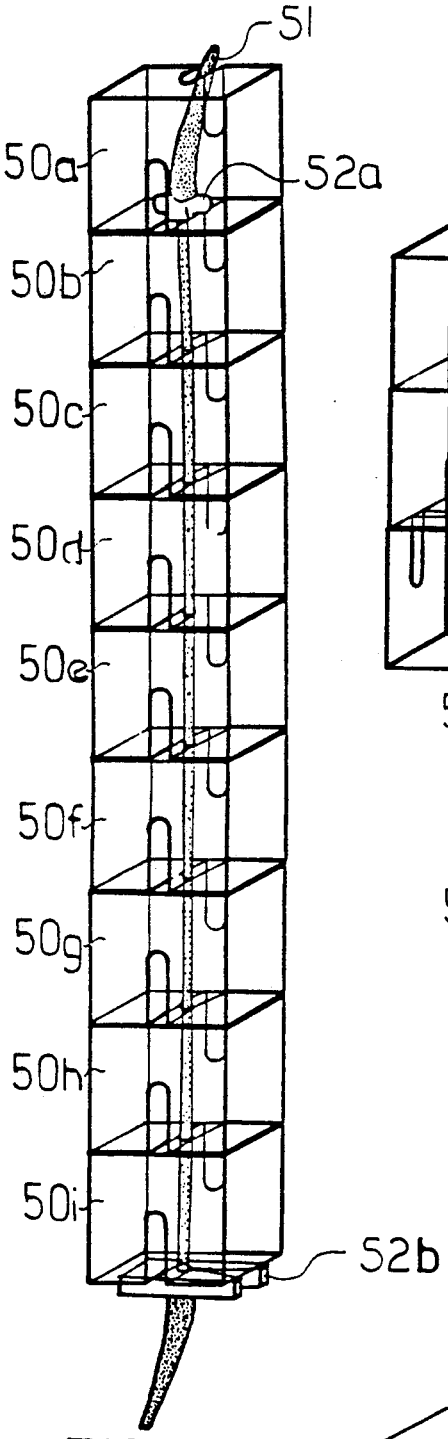
Figure 5B:
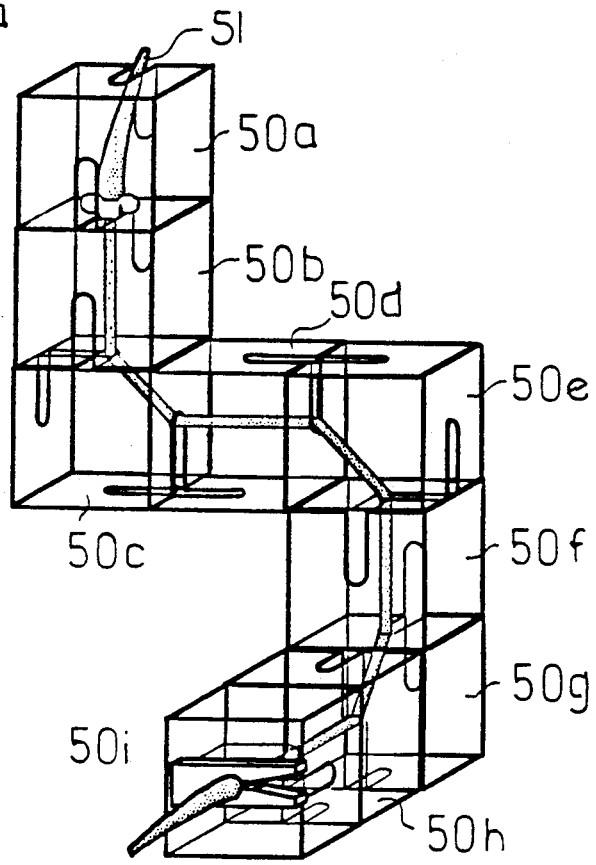

FIGS. 5*a* and 5*b* are illustrations of assemblies using a cubic building block to demonstrate the threading of the elastic cord for straight configuration and different corner configurations of building blocks.

Figure 6:
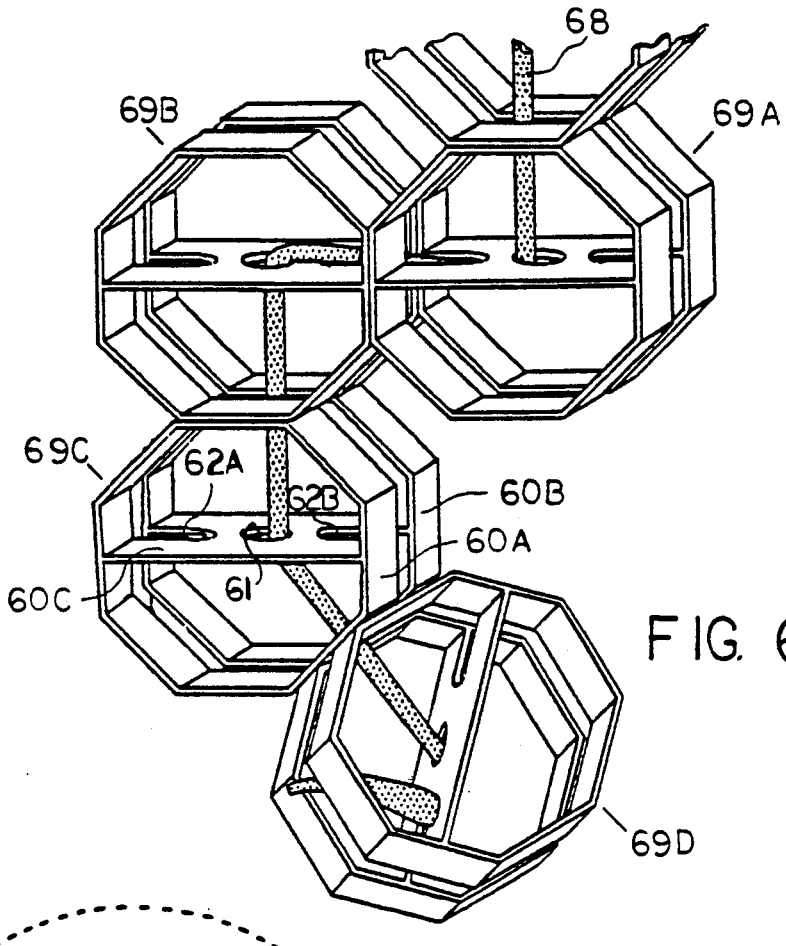

FIG. 6 is an illustration of an assembly using an 8 faced polyhedral ring building block to demonstrate the threading of the elastic cord for straight, 45 degree angle and 90 degree corner configurations.

Figure 7:
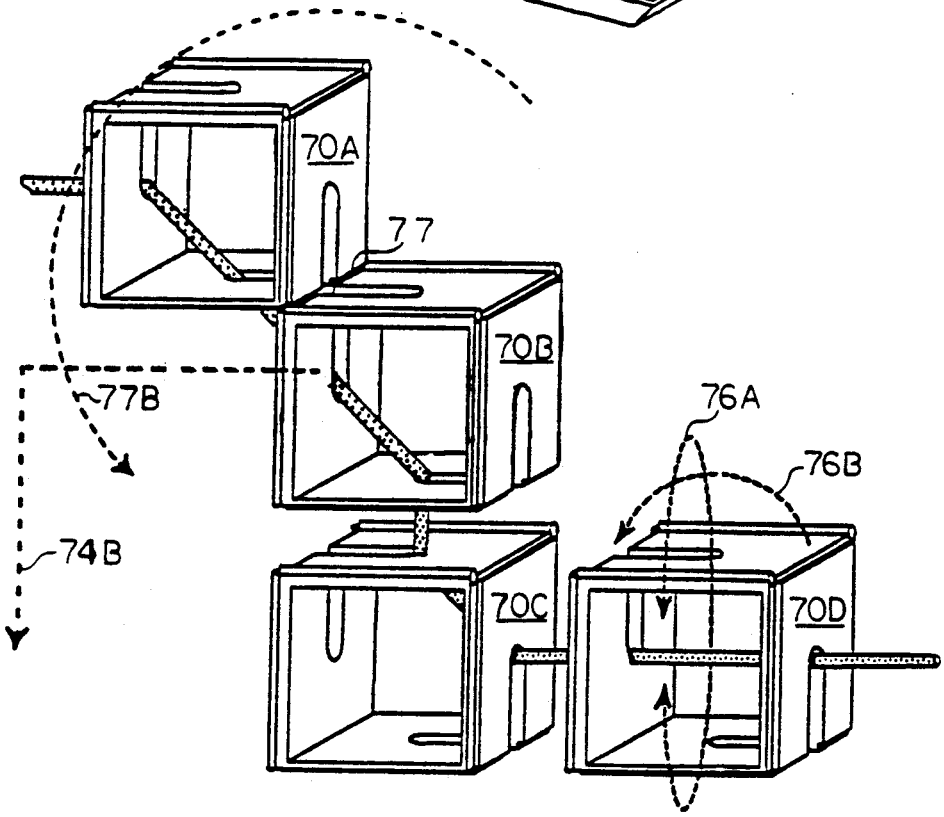

FIG. 7 is an illustration of an assembly using a cubic building block for demonstrating rotational, rolling, shifting, and pivotal movement of adjacent building blocks.

Figure 8:
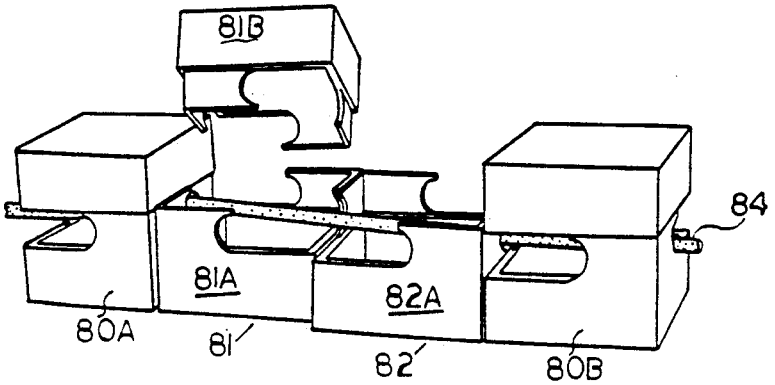

FIG. 8 is an illustration of a two-part cubic building block demonstrating the side threading insertion of an additiona; building block into an existing assembly of threaded building blocks.

Figures 9A, 9B, 9C:
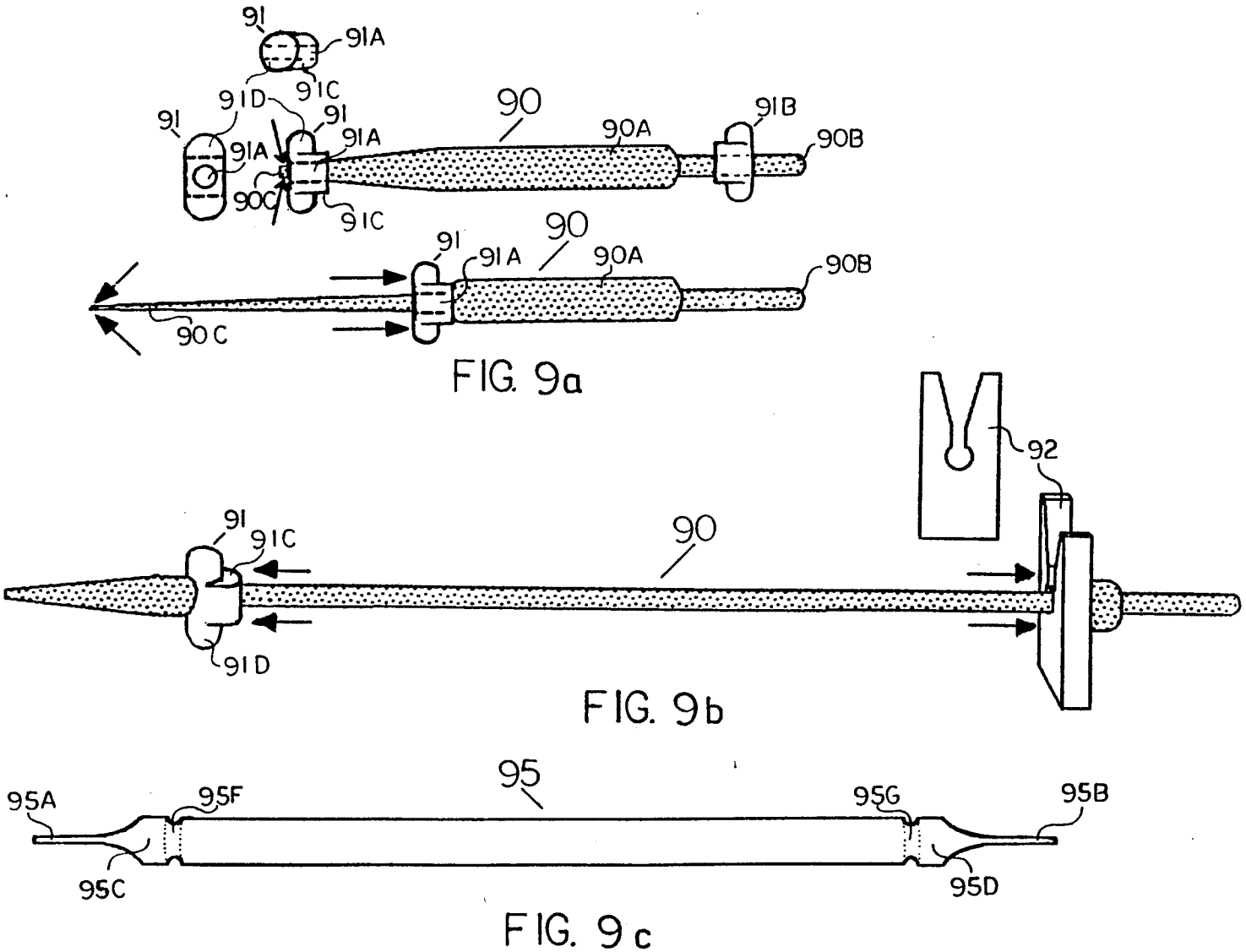

FIGS. 9*a* through 9*c* are illustrations of the elastic cord and termination tools used to string the building blocks of the present invention.

Figure 10:
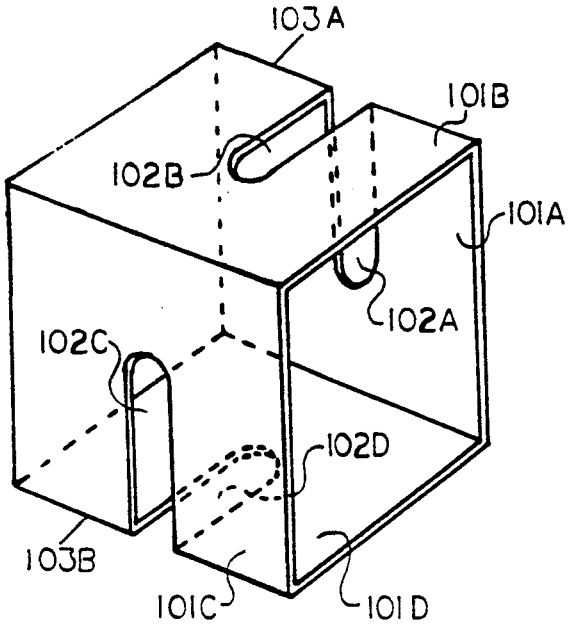

FIG. 10 is a perspective view of a cookie cutter type cubic building block.

Figure 11:
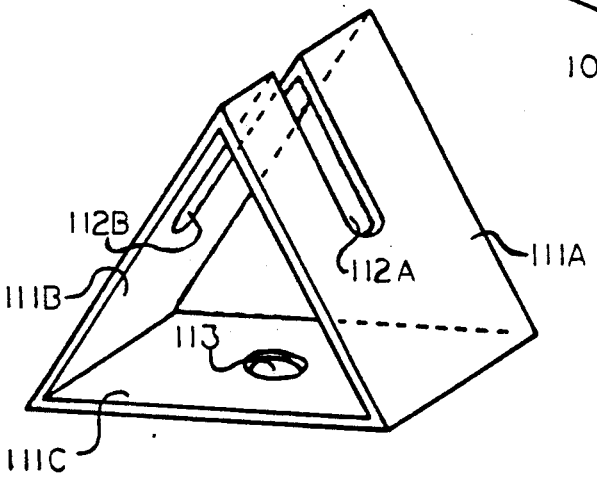

FIG. 11 is a perspective view of a first type wedge building block.

Figure 12:
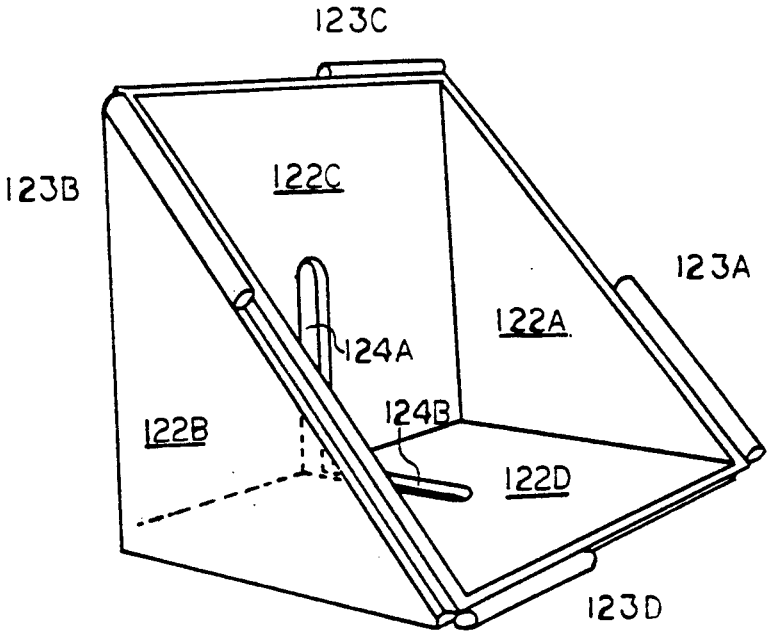

FIG. 12 is a perspective view of a second wedge type building block which has closed triangular faces and an open-sided interface.

Figure 13:
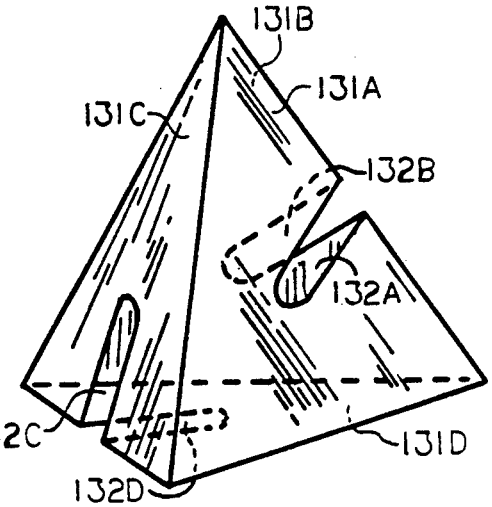

FIG. 13 is an illustration of a tetrahedron with two double slots.

Figure 14:
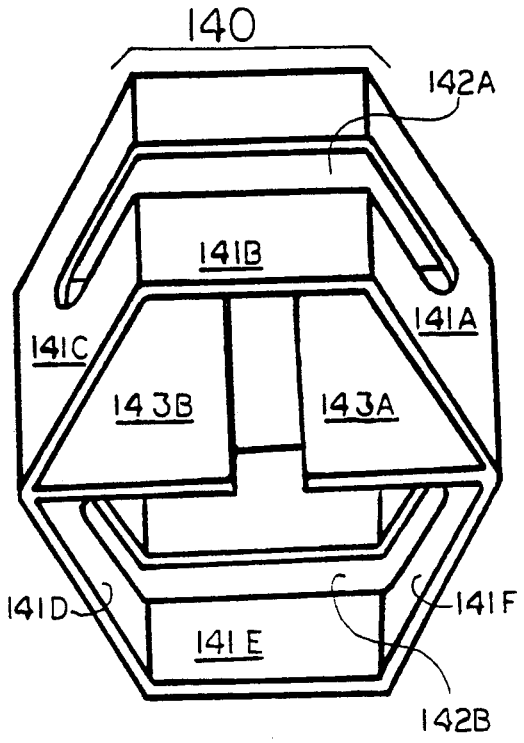

FIG. 14 is an illustration of a hexagonal cookie cutter building block.

Figure 15:
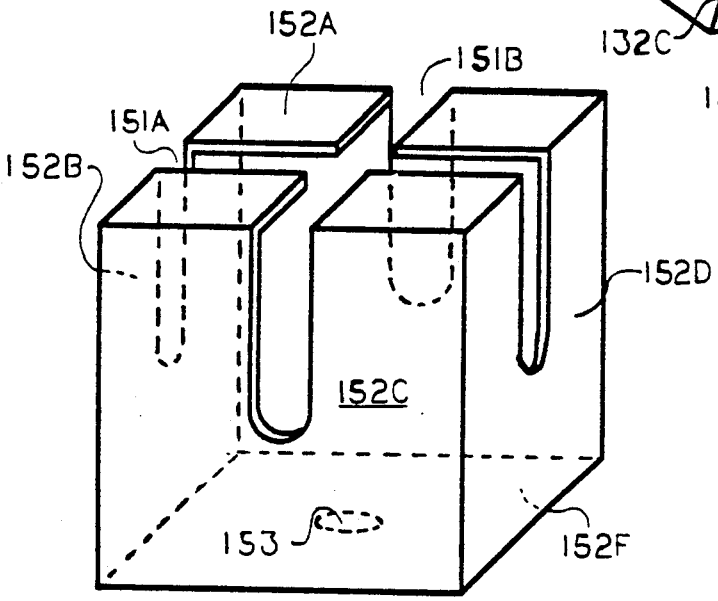

FIG. 15 is an illustration of a cubic building block (hexahedron) having two slots crossing each other on one face.

Figure 16:
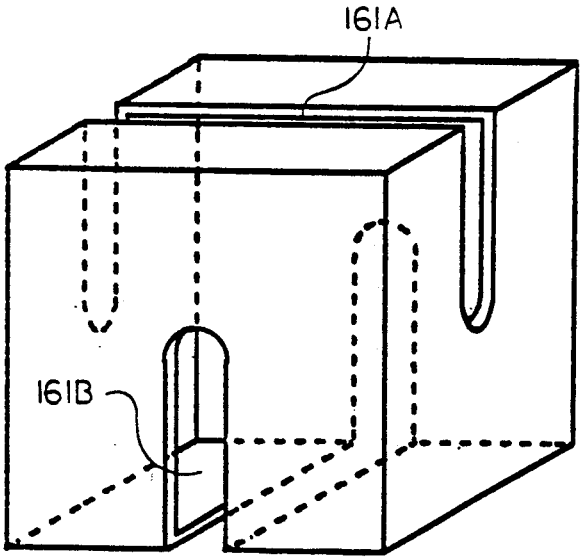

FIG. 16 is an illustration of a cubic building block having two slots each extending over three faces.

Figure 17:
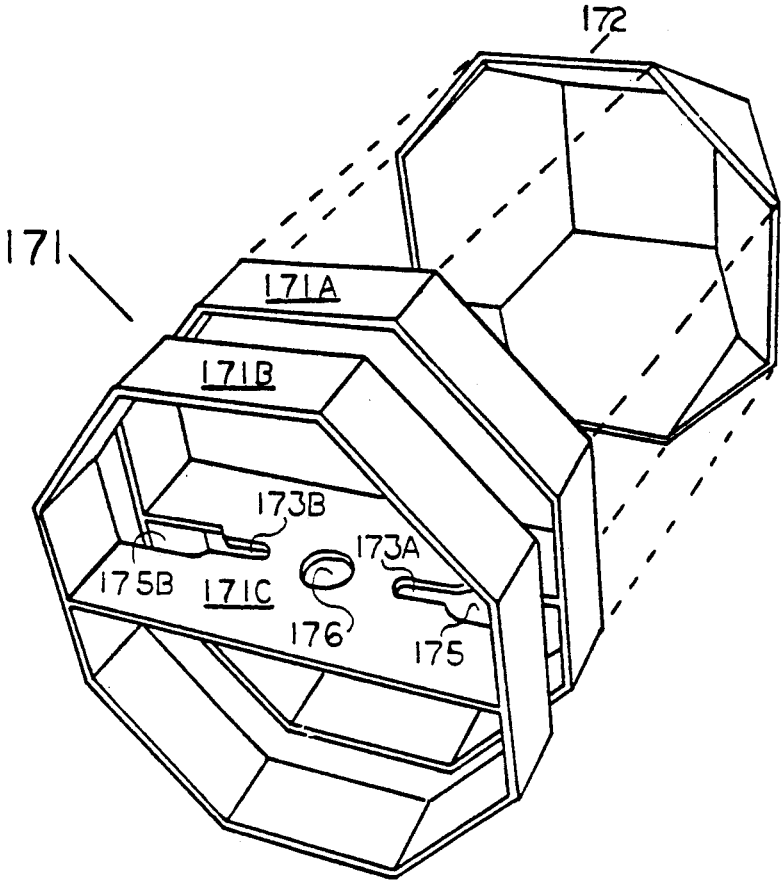

FIG. 17 is an illustration of the octagonal polyhedral ring building block having a pair of planar 180° slots with one of two attachments for transforming the body into a 16-face polyhedron.

Figure 18:
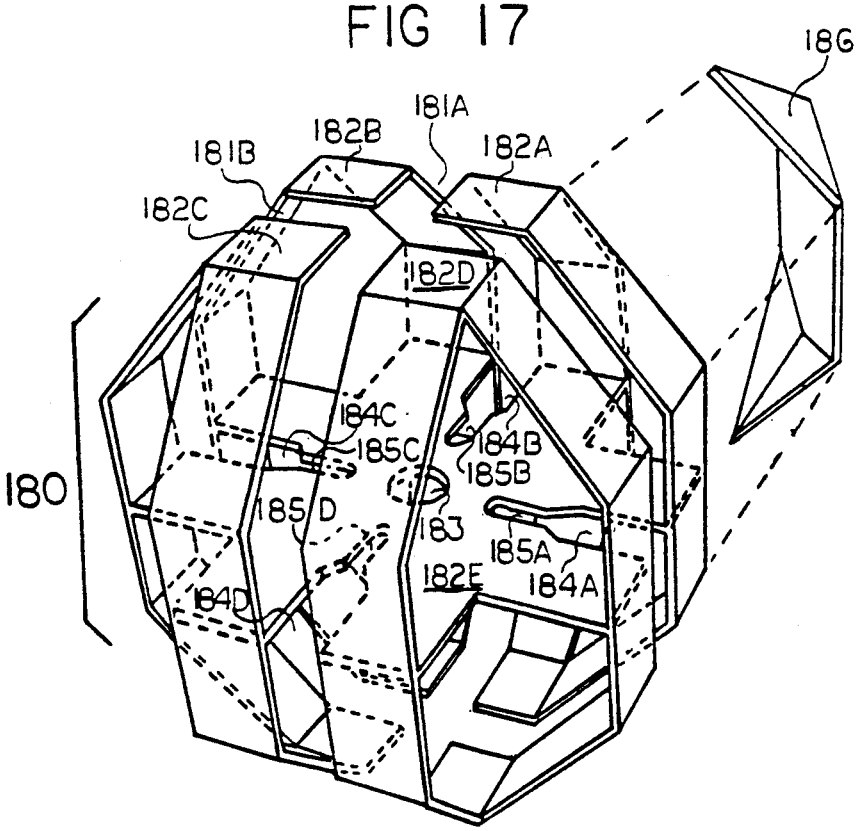

FIG. 18 is an illustration of a building block having two 90° offset pairs of planar 180° slots with one to four attachments for transforming the building block into a 16-face polyhedron.

Figure 19:
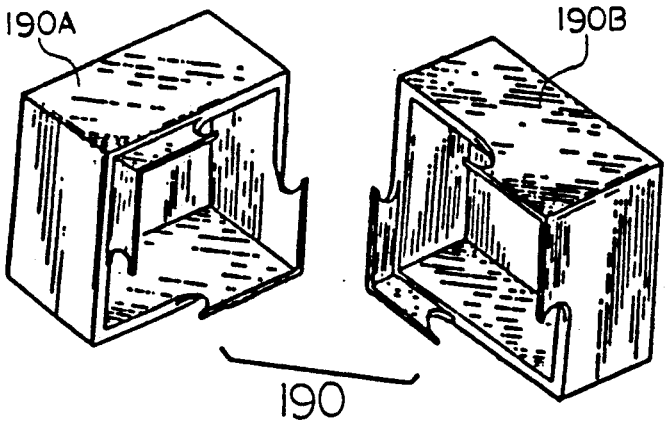

FIG. 19 is an illustration of a disassembled two part cubic building block designed to be inserted into an existing configuration of building blocks.

Figure 20:
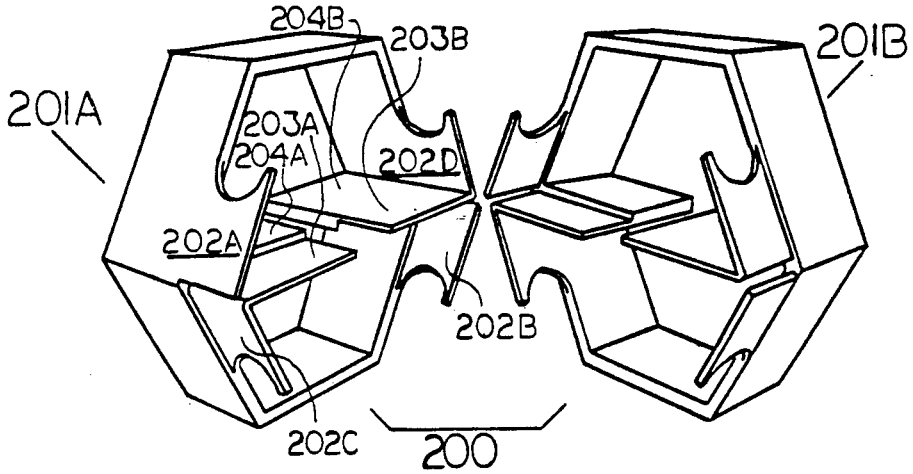

FIG. 20 is an illustration of a disassembled two part hexagonal building block designed to be inserted into an existing configuration of building blocks.

Figure 21:
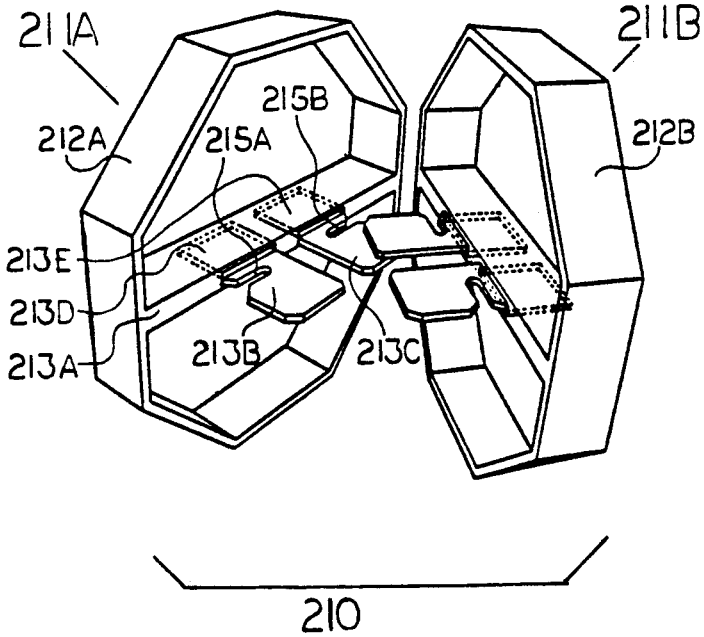

FIG. 21 is an illustration of a disassembled two part octagonal ring building block.

Figure 22A:
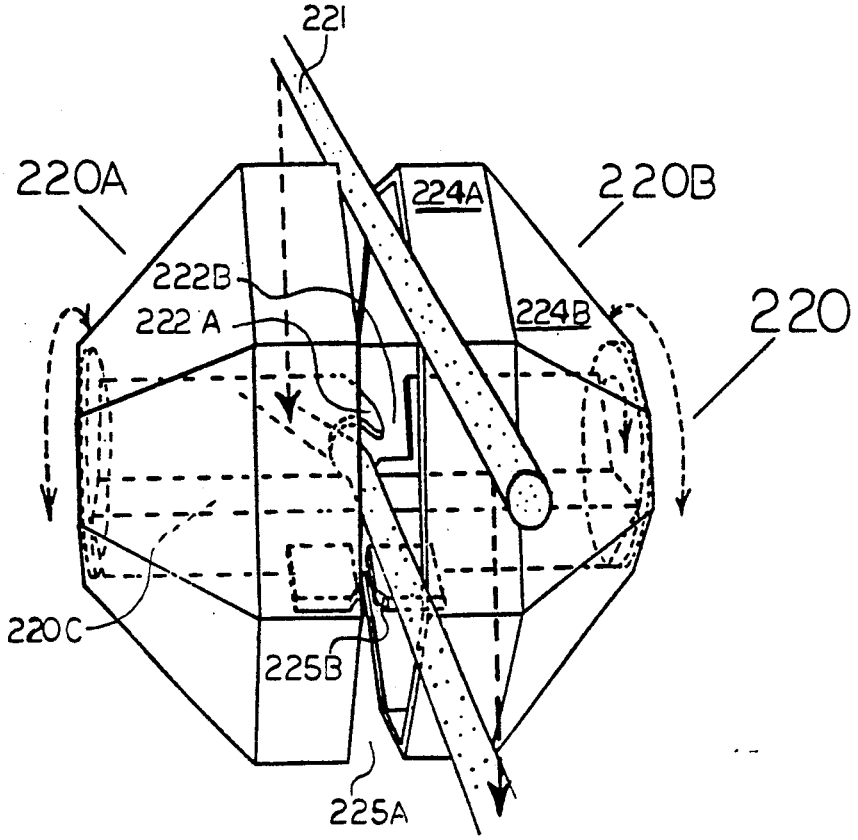
Figure 22B:
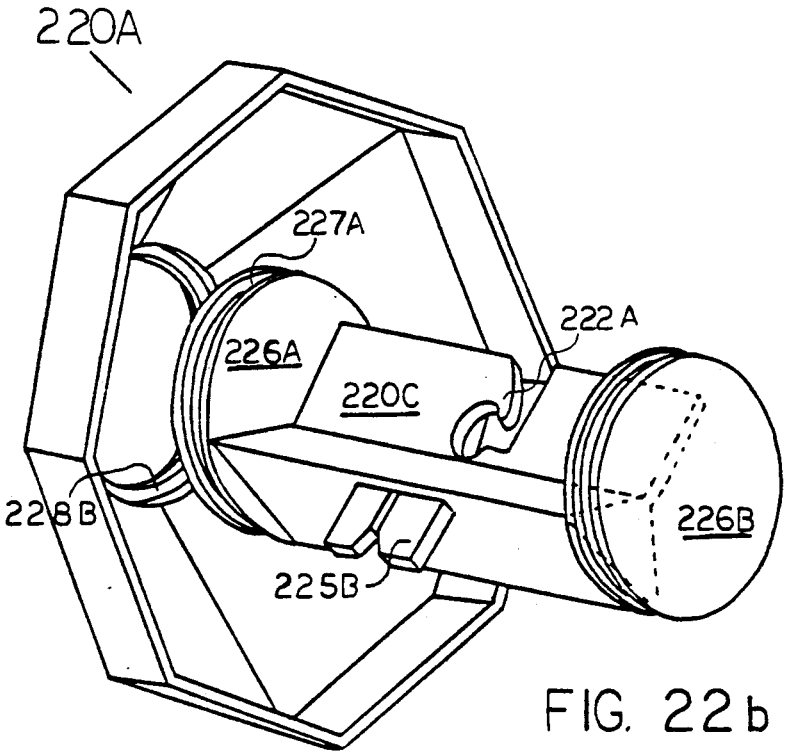

FIGS. 22*a* and 22*b* are illustrations of a building block with a 360 degree slot, a central common axis guide and a rotational polyhedron body.

Figure 23:
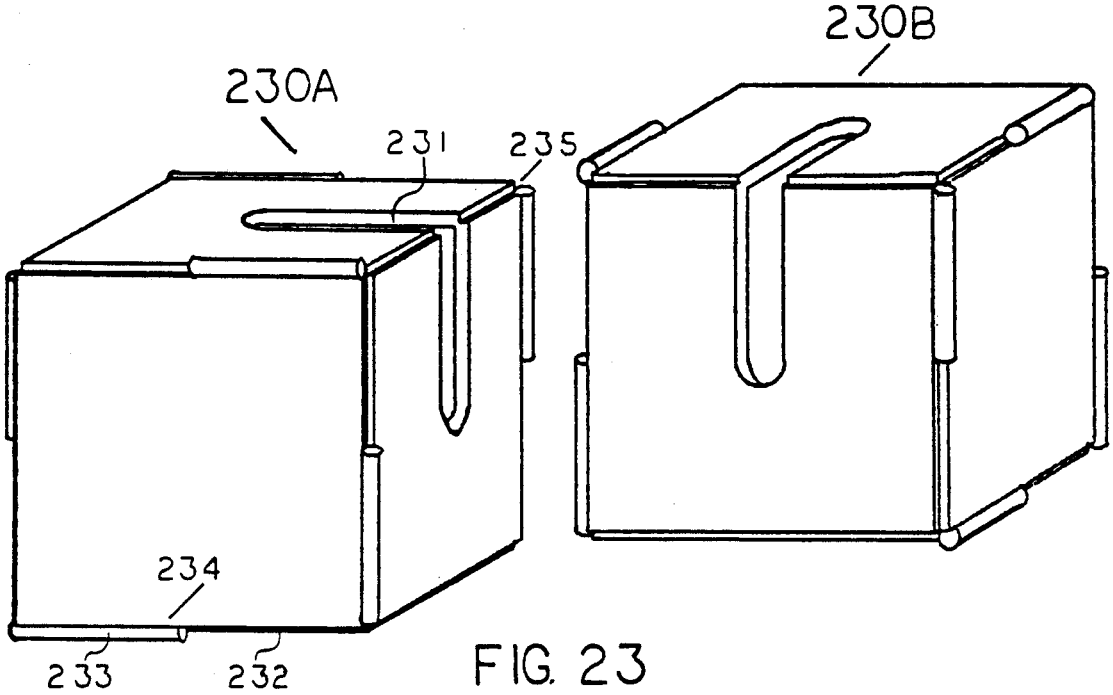

FIG. 23 is an illustration of two cubic building blocks with enforced edges which prevent rotation and slipping of adjacent blocks.

Figure 24:
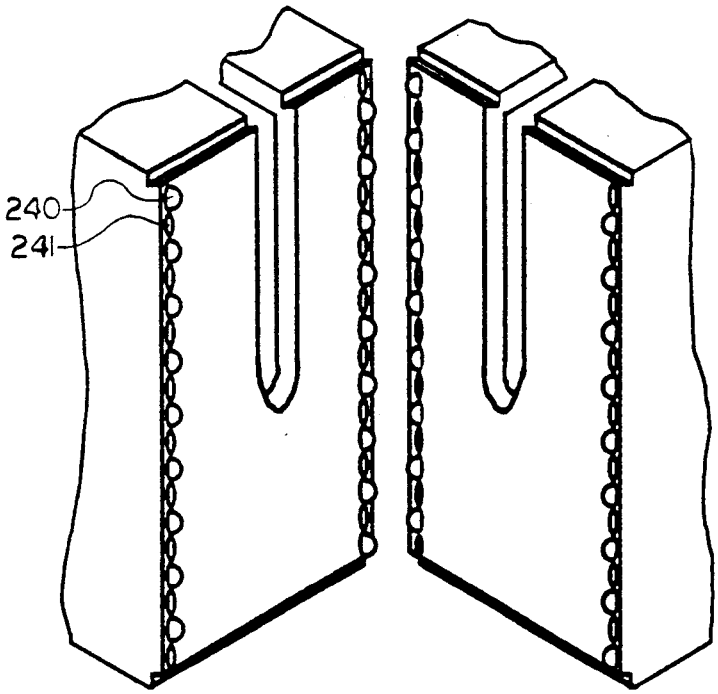

FIG. 24 is an illustration of another interlocking pattern for building blocks.

Figure 25:
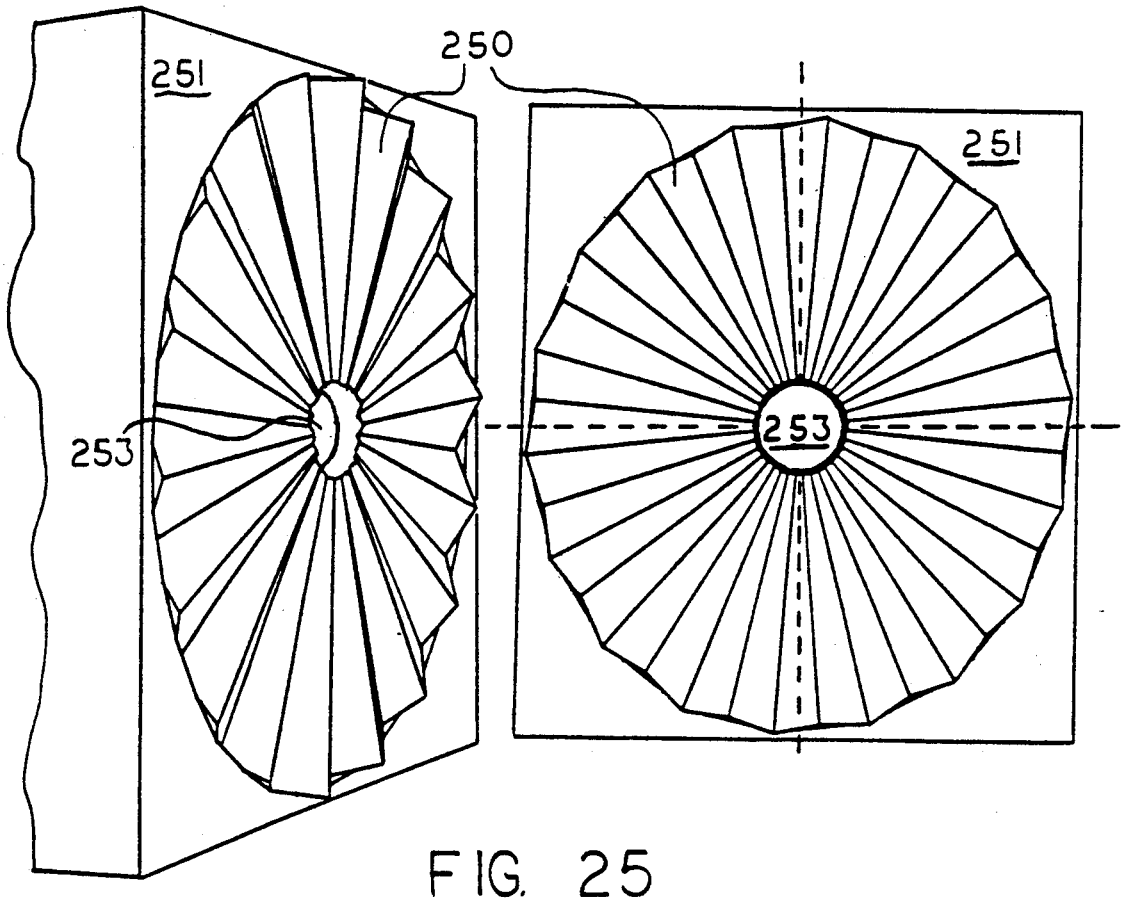

FIG. 25 is an illustration of an interface for preventing rotational and sliding movement between adjacent building blocks.

Figure 26:
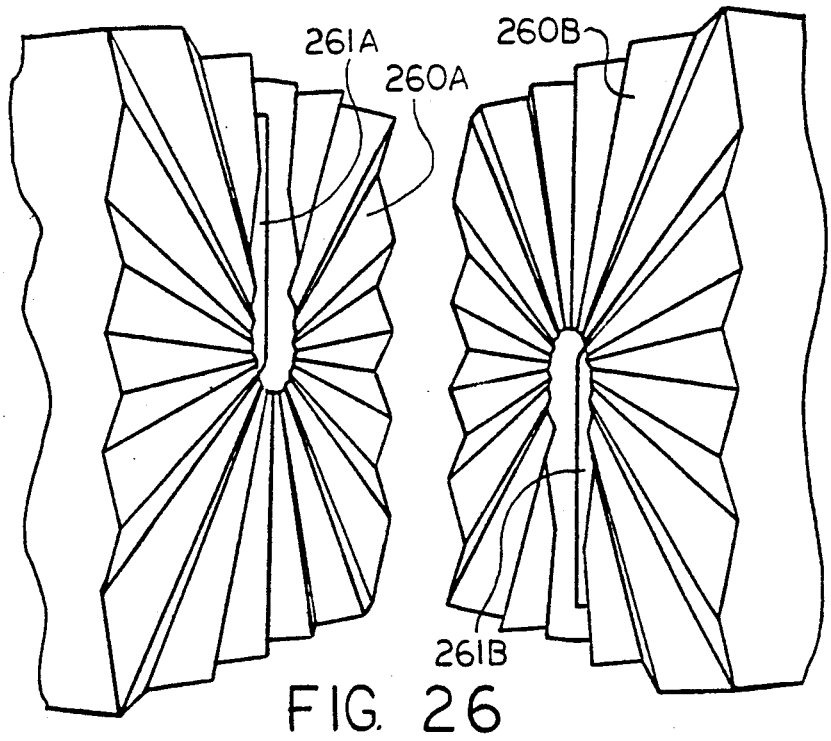

FIG. 26 is an illustration of a building block interface as described with reference to FIG. 25.

Figure 27:
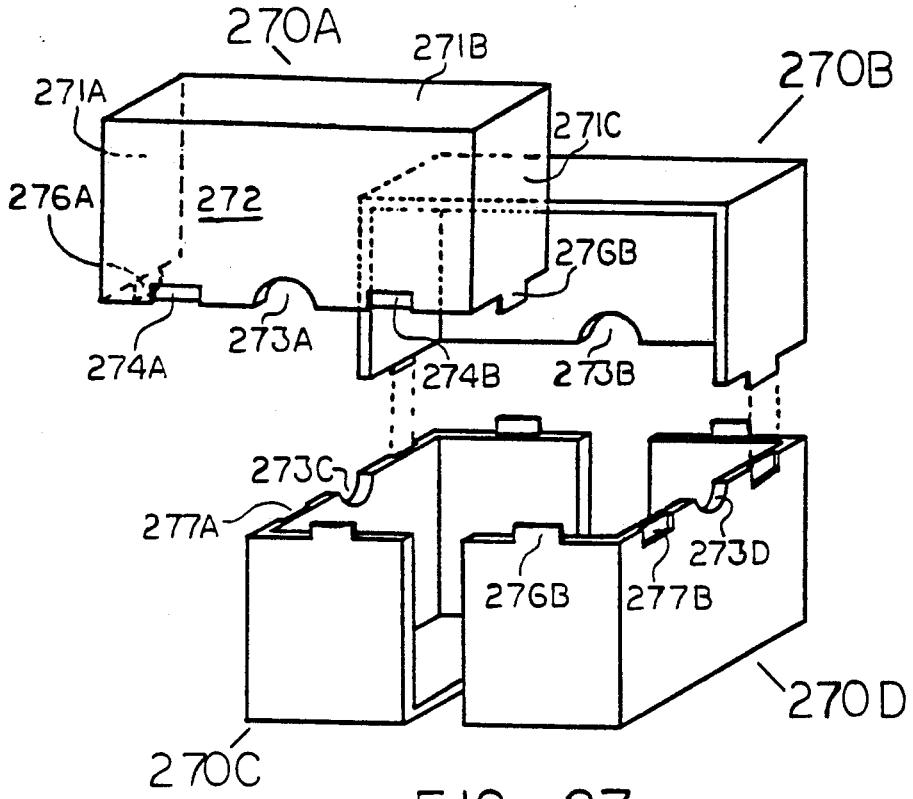

FIG. 27 is an illustration of the components of a building block having two slots each extending over three faces assembled from 4 equal bodies.

Figure 28:
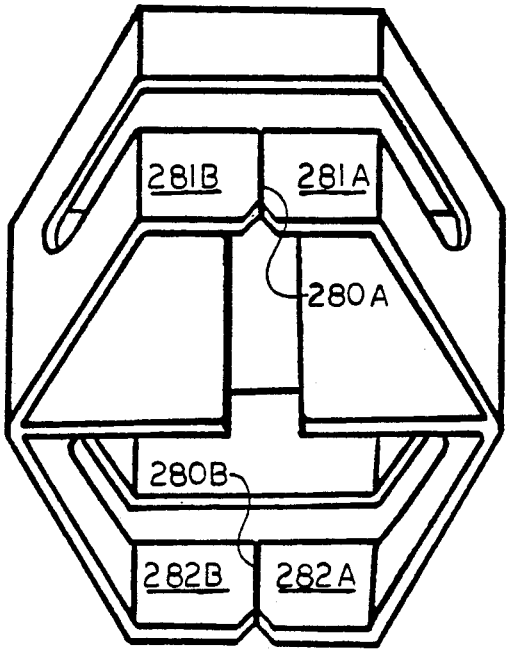

FIG. 28 is an illustration of a hexagonal ring building block as shown in FIG. 14 but having two additional slits for side threading.

Figure 29:
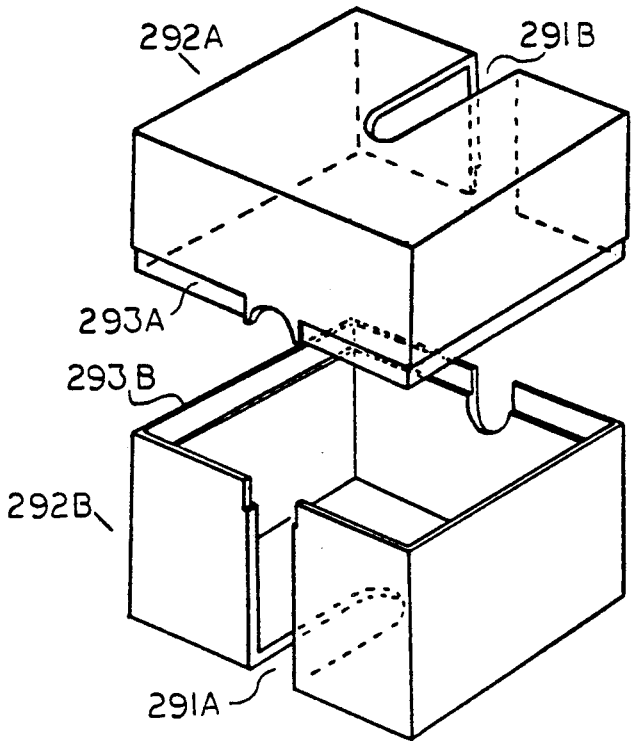
Figure 30A:
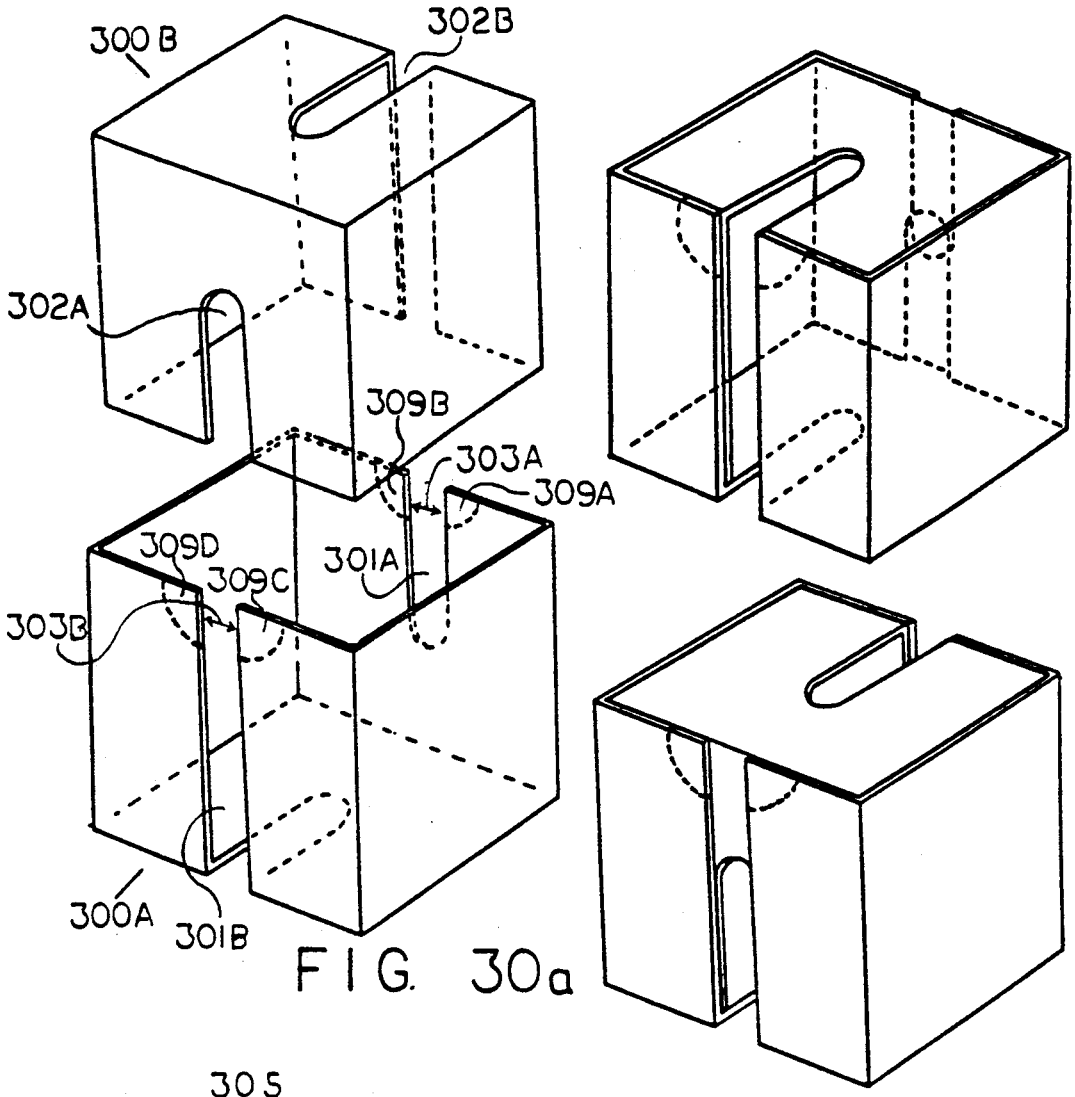
Figure 30B:
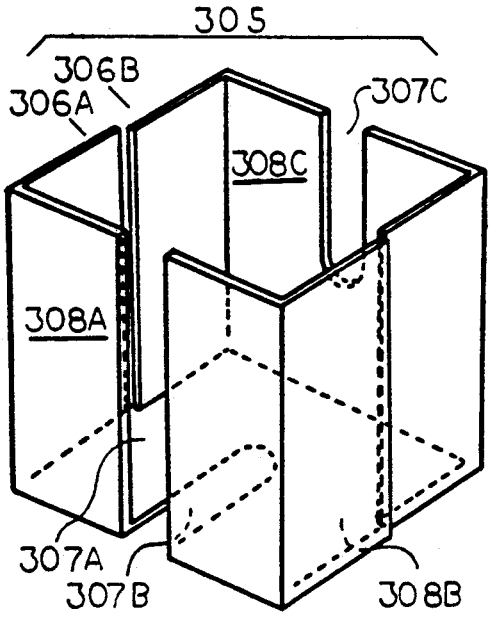
Figure 30C:
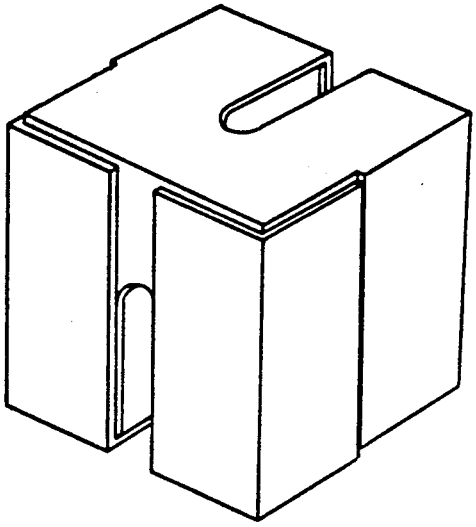

FIG. 29 is an illustration of a disassembled cubic building block with two two-face slots in a common plane FIGS. 30*a*, 30*b* and 30*c* are illustrations of building blocks assembled from two boxlike halves.

DESCRIPTION OF THE PREFERRED EMBODIMENT

FIGS. 1 through 4 are illustrations of assemblies using cube shaped building blocks with edges shaved off at 45 degrees. The building blocks are in a row and then transformed by rolling, rotating, pivoting or shifting adjacent building blocks to form the shown configuration.

Figure 1:
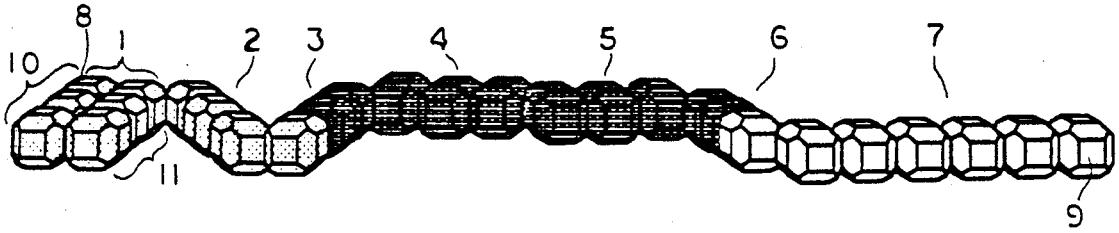
FIG. 1 is an illustration of an assembly of building blocks forming a snake, a two-dimensional single thread configuration.

FIG. 1 is an illustration of an assembly of building blocks forming a snake, a two-dimensional single thread configuration. All building blocks are threaded on one elastic cord. Adjacent building blocks interface at their flat surfaces. The configuration is the result of a transformation by rolling and shifting selected building blocks.

The snake of FIG. 1 is assembled from 27 polyhedrons each having 18 surfaces, 6 major surfaces and 12 minor surfaces at 45 degree angle between the major surfaces. Two building blocks which may be used for such a configuration are disclosed in more detail with reference to FIGS. 17 and 18. The 27 polyhedron building blocks are strung on one elastic cord. After stretching the cord the ends of the cord are secured in the first building block 8 and last building block 9. The 'snake' is formed by rolling selected building blocks of the stringed building blocks relative to the adjacent building blocks. Head 1 of the snake is formed by two parallel rows 10 and 11 of three building blocks.

The body of the snake consists of five segments 2 through 6 of 3 building blocks each, and a tail segment 7 of two times three building blocks. Segment 2 angles off head 1 at 135 degree by clockwise rotation of segment 2 from segment 11. Segment 3 angles off segment 2 135 degree by counter-clockwise rotation of segment 3 from segment 2. Segment 4 angles off segment 3 at 90 degree by clockwise rotation of segment 4 from segment 3. Segment 5 angles off segment 4 at 45 degree by counter-clockwise rotation of segment 5 from segment 4. Segment 6 angles off segment 5 at 90 degree by clockwise rotation of segment 6 from segment 5. Tail segment 7 angles off segment 6 at 90 degree by counter-clockwise rotation of segment 7 from segment 6. (All rotations seen from the top.)

Figure 2:
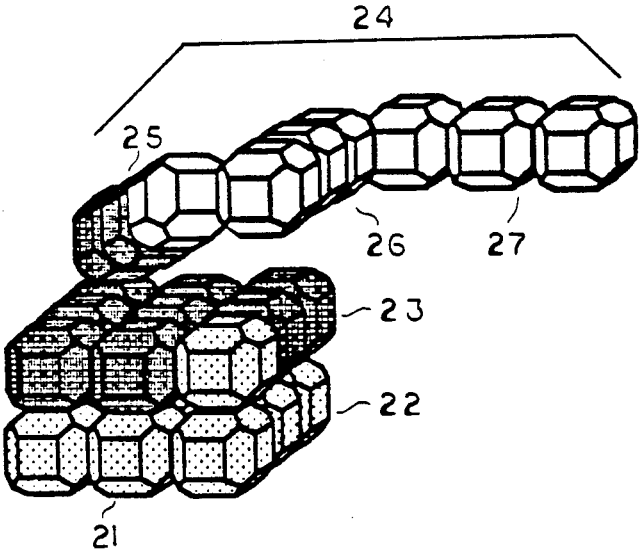
FIG. 2 is an illustration of an assembly of building blocks forming a base and an attached arm like a crane.

FIG. 2 is an illustration of an assembly of building blocks forming a base and an attached arm like a 'crane'. This configuration uses the same type and number of building blocks as the 'snake' of FIG. 1. The 'crane' is the result of a transformation by shifting, rolling, or rotating selected building blocks.

Base 21 of the 'crane' in FIG. 2 consists of 6 segments of 3 building blocks each. Bottom layer 22 has three segments just placed next to each other in one plane, that means the first and second segment angle off at 180 degree in one direction and the second and third segment angle off each other at 180 degree in the opposite direction. The first building block of the fourth segment angles off the last building block of the third segment at 90 degree upwards, the second building block of the fourth segment angle at 90 degree of the preceding block and establishes the direction of the fourth segment. The fifth and sixth segments run parallel to the fourth segment in a plane parallel to the plane of bottom layer 22. The fourth, fifth and sixth segment constitute top layer 23 of base 21.

Arm 24 of the 'crane' begins at the last block of the sixth segment, the rear corner of base 21. It is not a straight arm and consists of three segments 25, 26, and 27 each consisting of three building blocks. While each segment of the 'crane' in FIG. 2 consists of three building blocks, it is not a requirement of the system, however, the two configurations of FIGS. 1 and 2 demonstrate how one assembly can be transformed into two different configurations.

The configurations shown in FIGS. 1 and 2 are first assembled by threading the required number of building blocks on an elastic cord, and then after tension is established it can be transformed to the desired configuration by rolling, rotating, or shifting selected building blocks relative to their adjacent building blocks.

FIGS. 1 and 2 also illustrate how to use this invention to develop an understanding of multiplication, division, volume and cubic numbers.

FIGS. 1 and 2 are illustrations of different configurations of the same assembly. In the straight configuration the assembly can be thought of as a number line from 1 to 27. Section 8*a* is made up of 10 light colored blocks, section 8*b*, contains another 10 blocks colored in a contrasting darker color, while section 8*c* contains 7 white blocks.

Children who have become thoroughly familiar with counting, base 10 concepts, and addition and subtraction soon discover to quickly if not instantly recognize the number of any particular block on the number line. They do this by seeing its position relative to, and within, the groups of 10.

As well, they know that the number line attributes hold constant even as the line is folded and doubled back on itself.

FIG. 1 illustrates how folding by segments of 3 will provide a kinesthetic model, not only of counting by three, but any number from 1 to 9, times 3. Likewise it will show any number between 3 and 27, divided by 3.

FIG. 2 illustrates how, after folding the number line at every segment of three blocks, folding back again by three forms square layers of 9 ($3\times3$) blocks and ultimately a cube (expressed $3\times3\times3$ or $3^2$) whose volume is 27 blocks.

Figure 3:
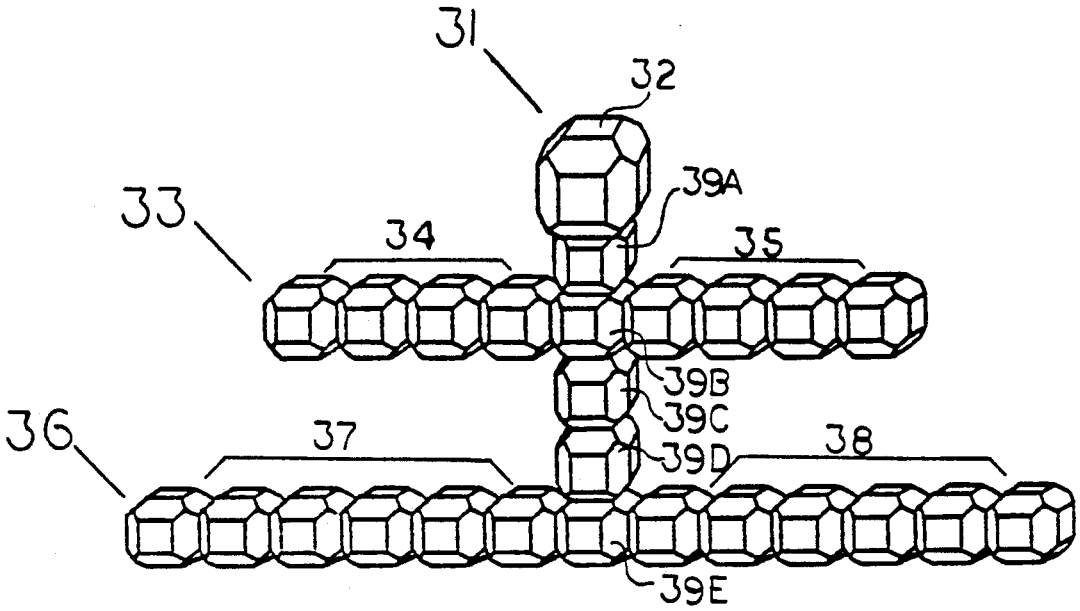
FIG. 3 is an illustration of an assembly of building blocks forming an athlete in spread leg position, a multiple thread, two-dimensional configuration.

FIG. 3 is an illustration of an assembly of building blocks forming an athlete with spread legs, a multiple thread assembly, two-dimensional configuration.

The configuration shown in FIG. 3 consists of three assemblies of threaded building blocks. A first assembly 31 includes a large building block 32 in place of the head of the athlete and 5 small building blocks 39*a* through 39*e* for the rump. A second assembly 33 consists of 2 segments 34 and 35 of each 4 blocks. The third assembly 36 consists of two segments 37 and 38 of 6 blocks each.

To combine the three assemblied 31, 32, and 33 for the athlete of FIG. 3 assembly 33 is split between segments 34 and 35. The exposed elastic cord is inserted into the third block 39b of assembly 31 establishing the arms of the athlete. Assembly 36 is split between segments 37 and 38, and the exposed elastic cord is inserted in the last block 39e of assembly 31 establishing the spread legs of the athlete.

In general, a second string of building blocks can be attached to a first string of building blocks in three different ways:

1) by threading the cord of the second string of building blocks through the building block of the first string before the second string of building blocks is fully assembled;
2) by stretching the cord of the second string between two selected building blocks and squeezing the exposed stretched cord in between two building blocks of the first string of building blocks;
3) if the first string of building blocks has at the location of intersection with the second string of building blocks a building block with a slot across the interfacing surface with an adjacent building block and slot extensions on interface surfaces with building blocks of the second string of building blocks, then the exposed stretched cord of the second string of building blocks can be slid into that slot of the selected building block of the first string of building blocks. The ends of the slots used have to establish one common central axis with the adjacent building blocks of the inserted string of building blocks.

Figure 4:
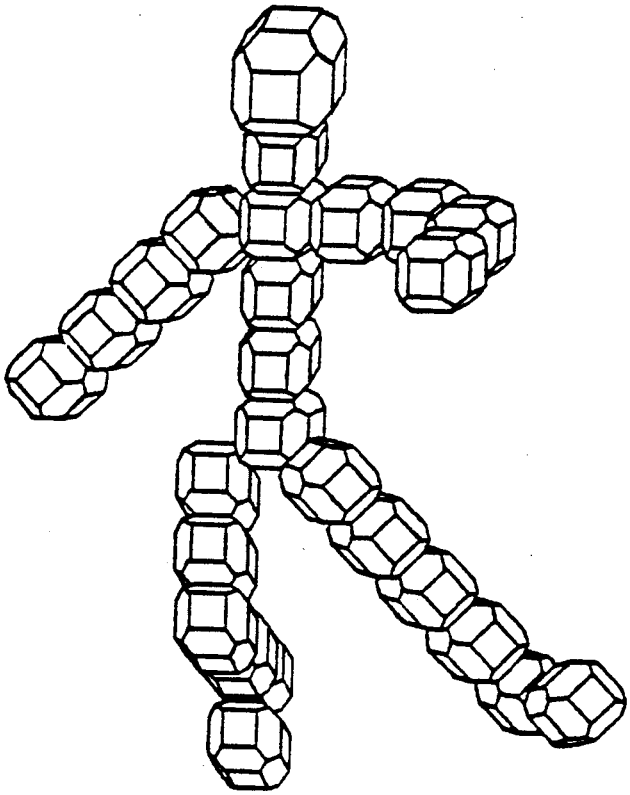
FIG. 4 is an illustration of an arrangement of building blocks using the same assembly as used in the arrangement of FIG. 3, forming the three-dimensional figure of an ice or roller skater.

FIG. 4 is an illustration of the same assembly used the arrangement shown in FIG. 3, however, some of the building blocks have been repositioned relative to their adjacent blocks, resulting in a new configuration, a three-dimensional figure of an ice or roller skater.

FIGS. 5a, 5b, and 6 through 8 are illustrations of different ways to route the elastic cord through building blocks to achieve different postures of adjacent building blocks. These Figures help understanding the different ways to transform a configuration by changing the relative position between adjacent building blocks using four different operations.

FIG. 5a is an illustration of a straight configuration of cubic building blocks 50a through 50i and termination of elastic cord 51 at the ends of the assembly. For demonstration purposes all building blocks have been oriented in the same direction. FIG. 5b shows routing of elastic cord 51 through the building blocks after the configuration shown in FIG. 5a is transformed by rotating and pivoting selected building blocks or segments of building blocks.

The assembly of FIG. 5a consists of 9 transparent and hollow blocks 50a through 50i, an elastic cord 51 and two terminators 52a and 52b. The function of terminators 52a and 52b are described in more detail with reference to FIG. 9. Blocks 50a through 50i are open sided hollow cubic bodies as shown in detail on FIG. 10. Each of the building blocks 50a through 50i have two slots crossing opposing edges (see FIG. 10). Each of the two slots has two slot sections which end at the center of adjacent faces. To form the shown configuration of building blocks 50a through 50i cord 51 is threaded through the slots of the building blocks and finally tension is established and the cord is secured in the terminal building blocks. In FIG. 5a one end of cord 51 is held in place by terminator 52a on the inside of the lower slot of building block 50a. Cord 51 is threaded through the upper slot and lower slot of building block 50b and upper slot of block 50c and so forth until it is threaded through building block 50i. As soon as tension is established on cord 51 a clamping terminator 52b is placed on cord 51.

To transform to the configuration of FIG. 5a to the configuration shown in FIG. 5b the first two blocks 50a, and 50b remain in their relative position.

Step 1: Building block 50c together with blocks 50d through 50i is rotated counterclockwise (seen from the top of the assembly) relative to building block 50b so that its front side points to the right.

Step 2: Stacked blocks 50d through 50i are shifted to the right and upwards relative to blocks 50a through 50c and then rotated by 180 degree so that block 50d interfaces with a side face of block 50c.

Step 3: To start on the next corner arrangement block 50e, together with blocks 50f through 50i, is pivoted clockwise (seen from the front). Now blocks 50f through 50i point downwards.

Step 4: To start the last corner so that blocks 50h and 50i point towards the viewer in FIG. 5 block 50g, together with blocks 50h and 50i, is rotated counterclockwise.

Step 5: The last steps for establishing the configuration of FIG. 5b are to pivot block 50h together with block 50i from the bottom face of block 50g to the front face of block 50g, and to rotate building block 50i counterclockwise.

FIG. 5b clearly shows how the ends of the slots at corners of a configuration establish the common axes for adjacent building blocks; and how elastic cord 51 is routed between centers of faces of adjacent building blocks.

As can be seen in FIG. 5 the configuration can easily be changed by stretching cord 51 between blocks 50d and 50e, and then rotating the configuration consisting of blocks 50e through 50i counterclockwise. The result would be a configuration having a straight center section consisting of blocks 50d through 50f.

FIG. 6 is an illustration of an partial assembly using an 8 faced polyhedral ring building block to demonstrate the threading of the elastic cord for straight, 45 degree, and 90 degree corner assemblies. The 8-faced polyhedral ring building block used in this assembly for demonstration is described in detail with reference to FIG. 17.

The 8-faced polyhedral ring building blocks 69a through 69d used in the configuration shown in FIG. 6 are of the cookie-cutter type. They consist of two octagonal rings 60a and 60b held spaced apart and in a co-axial arrangement by a board 60c, see building block 69c. The spacing between octagonal rings 60a and 60b provides for a pair of planar 180° degree slots around the entire circumference. In terms of functioning this pair of slots consist of two opposing slots overlapping in the same plane. Board 60c has a hole 61 in the center and two slots 62a and 62b on either side of hole 61 and spaced from hole 61. Hole 61 establishes the common axis with adjacent building blocks. Slots 62a and 62b extend to the ends of board 60c into the space between octagonal rings 60a and 60b to allow interfacing with another building block on surfaces connected with board 60c. The configuration of FIG. 6 demonstrates the routing of elastic cord 68 for a straight center-center interface between blocks 69b and 69c, a 90 degree interface between blocks 69a and 69b, and a 45 degree interface with a 90 degree rotation from block 69c to 69d.

FIG. 7 is an illustration of an assembly using cubic building block for demonstrating rotational, shift, roll, and pivotal movement of adjacent building blocks. The configuration uses four blocks 70a, 70b, 70c and 70d. Cord 71 passes through blocks 70a, 70b, 70c and 70d in a similar fashion as cord 51 passes through blocks 50c, 50d, and 50e. In FIG. 7 arrows are used to indicate the freedom of movement between adjacent blocks.

Rolling is a rotational movement of a building block around the common edge with an adjacent building block: Building block 70a is rolling around common edge 77 it shares with building block 70b as indicated by arrow 77b. It is changing its relative position from being placed on top of building block 70b to being attached to the left side of building block 70b. Both the building blocks 70a and 70b change interfacing surfaces.

Shifting a building block is demonstrated at the interface of building blocks 70b and 70c. (In this description it is disregarded that building block 70a is attached to building block 70b.) As indicated by arrow 74b building block 70b is first moved to the left until it can be moved downwards to a position where it attaches to the left side of building block 70c. In this operation the basic orientation of building block 70b is not changed. However, both the building blocks 70b and 70c change interfacing surfaces. At the end of this movement cord 71 passes through the slot section in the left side of building block 70b and the slot section in the right side of building block 70c. Common axis is established by these two slot sections.

Rotate (arrow 76a) and pivot (arrow 76b) operations are demonstrated with reference to building block 70d. In a pivot operation only the pivotted building block changes the interfacing surface. In a rotate operation no interface surface between adjacent building blocks is change, however, the rotated building block changes the orientation of all surfaces not normal to the common axis with the adjacent building block.

FIG. 8 illustrates how two-part cubic building blocks can be inserted into an existing assembly of threaded building blocks. In FIG. 8 a linear chain of blocks represented by blocks 80a and 80b is being expanded by insertion of two blocks 81 and 82. Blocks 80a and 80b are cubic bodies with two slots. For expansion box type cubic bodies 81 and 82 are used. Blocks 81 and 82 each have a base section 81a, 82a and a top section of which only top section 81b of building block 81 is shown in FIG. 8. After stretching cord 84 base sections 81a and 82a are inserted. Placing the top sections over the corresponding base sections completes the insertion. Blocks 81 and 82 can be shifted, rotated and pivoted in the same fashion as the equivalent single part block shown in FIG. 7.

FIG. 9 is an illustration of the elastic cord and termination tools used to assemble configurations of building blocks of the present invention. Except where building blocks include special slots for terminating a cord (see FIGS. 17, 18, and 21) separate terminators are required at the first and last building blocks of a configuration.

FIG. 9a is an illustration of a cord 90 having a round main section 90a with a first diameter, a tail section 90b with a smaller diameter and a conic front section 90c. The tip of front section 90c is inserted into the center hole 91a of terminator 91. By pulling on the tip of front section 90c it is stretched and thinned so that terminator 90 can be moved towards center section 90a. After releasing the pull on cord 90 terminator 91 is safely anchored on cord 90 (see FIG. 9b). When stretching cord 90 the diameter of the cord in center section 90a is reduced, however, the form of the cord beyond terminator 91 is maintained. In a similar manner cord end sections 90b and cord center section 90a can be stretched so that terminator 91b can be moved toward center section 90a.

Portion 91c of terminator 91 is squared oto a width nearly that of the slots in the polyhedron shells. When the crosspiece portion 91d is perpendicular to the slot, squared portion 91d slips into the slot and prevents the terminator from inadvertently slipping out of its holding position.

Another method of termination is shown in FIG. 9b at the right end of cord 90. Terminator 92 has the form of a cloth pin and is slipped over a part of center section 90a of cord 90. When cord 90 is stretched between terminators 91 and 92 the terminal part of center section 90a of cord 90 maintains its diameter and secures terminator 92.

The functionality of the cord can be improved by using a shaped cord such as cord 95 in FIG. 9c. Cord 95 has thin front and tail sections 95a and 95b to ease threading of terminators and building blocks. The diameter of cord 95 increases from the diameter of the front and tail sections 95a and 95b to the diameter of center section of cord 95 in sections 95c and 95d, which are of short length. Close to the ends of center section 95e there are two circumferential grooves 95f and 95g which can be used to secure cord 95 in special narrow slots provided with some of the building blocks, as will be described with reference to FIG. 17.

Description of the Building Blocks

FIG. 10 is a perspective view of a cookie cutter type cubic building block. The cubic block is formed like a cookie cutter with four equal sized square faces 101a, 101b, 101c, and 101d. The remaining two sides of the cube are open. Each one of the four faces 101a through 101d includes a slot 102a, 102b, 102c, and 102d. Slots start about a quarter of the slot width beyond the center of a face and are arranged in pairs. The first slot consists of slot sections 102a and 102b meeting at common edge 103a of faces 101a and 101b, and the second slot consists of slot sections 102c and 102d meeting at common edge 103b of faces 101c and 101d. An elastic cord routed through slot section 102a can hold an adjacent body on faces 101a. An elastic cord routed through slot section 102b can hold an adjacent body on faces 101b. An elastic cord routed through slot section 102c can hold an adjacent body on faces 101c. An elastic cord routed through slot section 102d can hold an adjacent body on faces 101d. Routing an elastic cord through slot section 102a and 102c placed the building block of FIG. 10 in a one sequence with two other building blocks. Routing an elastic cord through slot section 102b and 102d placed the building block in a different sequence with two other building blocks. Routing an elastic cord through slot section 102a and 102d placed the building block of FIG. 10 as a corner piece between two other building blocks. In that case the elastic cord is routed at 45 degree between slot sections 102a and 102d. Routing an elastic cord between slot sections 102b and 102c provides for another corner formation with two other building blocks.

As can be seen the slots provide for an easy way to change from a linear arrangement of three building blocks, using a building block of FIG. 10 as a center building block, to a corner arrangement, using this building block as a corner piece.

FIG. 11 is a perspective view of a first type wedge building block. The wedge body is established like a cookie cutter by three equal sized square faces 111*a*, 111*a*, and 111*c*. The two remaining triangular faces of the wedge building block are open. The two faces 111*a* and 111*b* include each a slot section 112*a*, respectively 112*b*. The slot sections start about a quarter width of the slot beyond the center of a face and are arranged the so that they meet at the common edge of faces 111*a* and 111*b*. Face 111*c* has a hole 113 in the center. An elastic cord threaded through hole 113 can hold an adjacent body on either one of faces 111*a* and 111*b*. The building block of FIG. 11 provide for a 60 degree corner in a configuration of building blocks.

FIG. 12 is a second wedge type building block which has closed triangular faces 122*a* and 122*b* and three square faces 122*c*, 122*d* and 122*e*, of which bottom face 122*e* is open. Bottom face 122*e* has four borders 123*a* through 123*d*. Borders 123*a* through 123*d* extend over less than half the length of the edges of bottom face 122*e*. When interfacing the second wedge type body with its open-sided bottom face 122*e* with an equally sized interface surface of another building block borders 123*a* through 123*d* prevent this second wedge type building block from sliding off the common central axis of the adjacent body.

The two faces 122*c* and 122*d* include each a slot 124*a*, 124*b*, respectively. The slots start at the center of a face and are arranged so that they meet at the intersection of faces 122*c* and 124*d*. An elastic cord threaded through either slot 124*a* or slot 122*b* is to be centered by the adjacent building block on which face 122*e* rests.

FIG. 13 is an illustration of a tetrahedron with two double slots. In FIG. 13 the tetrahedron has three faces 131*a*, 131*b*, and 131*c* and a bottom face 131*d*. Slot sections 132*a* and 132*b* in faces 131*a* and 131*b* start about one quarter of the width of the slot beyond the center of their respective face and meet in the middle of the common edge of the two faces. Slot sections 132*c* and 132*d* in faces 131*c* and 131*d* start about one quarter of the width of the slot beyond the center of their respective face and meet in the middle of the common edge of the two faces.

FIG. 14 is an illustration of hexagonal ring building block seen from its bottom side and having six faces 141*a*, 141*b*, 141*c*, 141*d*, 141*e*, and 141*f*. The bottom side and top side are open, so this building block belongs to the group of cookie cutters. Faces 141*a*, 141*b*, and 141*c* share slot 142*a*. Faces 141*d*, 141*e*, and 141*f* share slot 142*b*. Slot 142*a* starts about a quarter of the width of the slot beyond the center of face 141*a*, traverses face 141*b*, and ends about a quarter of the width of the slot beyond the center of face 141*c*. Slot 142*b* starts about one quarter of the width of the slot beyond the center of face 141*d*, traverses face 141*e*, and ends about one quarter of the width of the slot beyond the center of face 141*f*. Two separators 143*a* and 143*b* are attached at the inside of the body where faces 141*a* and 141*f*, respectively where faces 141*c* and 141*d* meet. Separators 143*a* and 143*b* leave a gap running perpendicular to slots 142*a* and 142*b*. The gap between separators 143*a* and 143*b* in combination with slots 142*a* and 142*b* centers a cord threaded through the two slots and the gap.

The hexagonal ring building block is used to interface other building blocks in a straight line, 60 degree or 120 degree angles.

FIG. 28 is an illustration of a hexagonal ring building block as shown in FIG. 14, however, this hexagonal ring building block is made from elastic material and includes slits 280*a* and 280*b* in faces 281*a* and 281*b* respectively. Slits 280*a* and 280*b* provide for side threading, i.e. slits 280*a* and 208*b* can be opened by bending opposite quarter surfaces 281*a* and 281*b*, respectively 282*a* and 282*b*, which enables the user to insert the building block of FIG. 28 into an existing assembly of building blocks without disassembly.

FIG. 15 is an illustration of another cube (hexahedron) having two slots 151*a* and 151*b* crossing on topside 152*a* and extending to the centers of faces 152*b*, 152*c*, 152*d*, and 152*e*. Face 152*f* has a hole 153 in the center for centering the threading cord.

FIG. 16 is still another cubic building block having two slots 161*a* and 161*b*. Slots 161*a* and 161*b* each span three faces of the cubic block. The planes of slots 161*a* and 161*b* are perpendicular to each other. When a threaded cord enters and exists from contiguous faces of the hollow body the cord is routed directly at a 45° angle through the interior between the opposing slots. When modifying interfacing with this block more attention (and often more steps) is necessary to orient the direction of the slots correctly for the desired change.

FIG. 17 is an illustration of a octagonal polyhedral building block 171 with one of two attachments 172 for converting the body into an (16)-side polyhedron. The attachments 172 do not have a slot and provide no functionality for stringing building blocks.

The 8-sided polyhedral cookie cutter type building blocks 171 consists of two octagonal rings 171*a* and 171*b* held spaced apart and in a co-axial arrangement by a board 171*c*. The spacing between octagonal rings 171*a* and 171*b* provides for a pair of planar 180° slots. Board 171*c* has a hole 176 in the center for establishing a common axis between adjacent building blocks. Two slots 175*a* and 175*b* on either side of hole 171*c* and spaced from hole 176 extend to the ends of board 60*c* into the space between octagonal rings 171*a* and 171*b*. Slots 175*a* and 175*b* provide for proper interfacing with other building blocks when the elastic cord of the assembly has to extend in the direction of board 171*c*.

The octagonal ring building block 171 includes narrow extension slots 173*a* and 173*b* of slots 175*a* and 175*b* in board 171*c*. Narrow extension slots 173*a* and 173*b* can be used to terminate a threading cord having a termination groove as shown in FIG. 9*d*. Such a termination is shown in FIG. 6 in a building block 60*d*. Board 171*c* could incorporate a hook for side threading. This could be done by replacing hole 176 and slot 173*b* with a hook such as hook 222*a* in FIG. 22*a*. The octagonal ring building block 171 can be modified by attaching on one or both open sides an attachment 172 thereby forming a closed polyhedron building block. Because attachment 172 does not have any slots it cannot interface with any other building block.

A two piece octagonal polyhedral building block which could be disassembled across slots for side threading (unlike block 210 of FIG. 21, which divides along the slot) would be similar and slip together like sections 300*a* and 300*b* of FIG. 30*a* or section 305 in FIG. 30*b*. Board 171*c* would be incorporated in one of the sections or better divided at hole 176 and incorporated into each half.

FIG. 18 is an illustration of a octagonal building block 180 with two 360 degree slots 181*a* and 181*b*. Building block 180 consists of four corner sections 182*a*, 182*b*, 182*c*, and 182*d* interconnected with each other by board 182*e*. Board 182*e* has a threading hole 183 in the center and four slots 184*a*, 184*b*, 184*c*, and 184*d* extending into the spaces between sections 182a through 182*d*.

Slots 184*a* through 184*d* connect to narrow extension slots 185*a* through 185*d*. Narrow extension slots 185*a* through 185*d* are provided for terminating an elastic cord of the type shown in FIG. 9*d*.

While building block 180 is shown in FIG. 18 as a functional building block, there are different ways to manufacture it, first it can be glued or welded together from five pieces 182*a* through 182*d* and board 182*e*, or it could be assembled from two sections, each including two corner pieces and half of a board 182*e*. Both sections may include additional means for assembling and disassembling the functional building block in a fashion similar to those of the building block of FIG. 21. In that case building block 180 would allow side threading, insertion in an existing assembly of building blocks.

Building block 180 can be complemented by corner insert 186 to close the open corners.

FIG. 19 is an illustration of a two part building block 190 designed to be inserted into an existing configuration of building blocks without disassembly of the configuration. Building block 190 consisting of base 190*a* and top 190*b* has the same characteristics as the cubic building block shown in FIG. 10, expect that it can be inserted into an existing configuration as described with reference to FIG. 8.

FIG. 20 is an illustration of a two part hexagonal building block 200 designed to be inserted into an existing configuration of building blocks. It consists of two equal hexagonal sections 201*a* and 201*b* each having extensions for establishing two slots between the sections and to link the two sections. Separators 204*a* and 204*b* provide for an internal slot in section 201*a*, separators 204*c* and 204*d* provide for an internal slot in section 201*b*. Functionally building block 200 corresponds to building block 140 described with reference to FIG. 14. Each of the sections 201*a* and 201*b* has two outer links 202*a* and 202*b*, and two inner links 202*c*, and 202*d* which determine the length and width of the slot between sections 201*a* and 201*b*. Outer links 202*a* and 202*b* overlap with inner links 202*c* and 202*d*, respectively when both sections are put together to form one building block 200. Separators 204*a* through 204*d* have links 203*a* through 203*d*. Link 203*a* overlaps with link 203*c*, link 203*b* overlaps with link 203*d* when sections 201*a* and 201*b* are put together. Separators may include grooves or notches to provide for a positive closure when assembling the two sections to a building block.

FIG. 21 is an illustration of a disassembled two part octagonal ring building block 210. Both sections 211*a* and 211*b* of building block 210 are identical. Section 211*a* consists of an octagonal ring 212*a*, and separator 213*a* connecting the centers of two opposite sides of octagonal ring 212*a*. Connected to separator 213*a* are two linking tongues 213*b* and 213*c* spaced apart by a slot width. Tongues 213*b* and 213*c* are offset from the center of separator 213*a*. Separator 213*a* includes two recesses 213*d* and 213*e* just next to tongues 213*b* and 213*c* and offset from the center of separator 213*a* by the same space as tongues 213*b* and 213*c* for receiving a corresponding tongue of the second section 211*b* of building block 210.

When assembling a building block 210 from sections 211*a* and 211*b* tongues 213*b* and 213*c* of one section extend into recesses 213*d* and 213*e* of the other section to provide for a 360 degree slot between the octagonal rings 212 of the two sections 211*a* and 211*b*. Tongues 213*b* and 213*c* each include a narrow slot 215*a* and 215*b* for terminating an elastic cord as shown in FIG. 6.

FIGS. 22*a* and 22*b* are illustrations of a building block with a 360 degree slot, a central common axis guide and a rotational polyhedron body. The body consist of two equal shells 220*a* and 220*b* mounted on a central body 220*c* spaced apart to provide a 360 degree slot 225*a* for receiving a cord 221 used to assemble this body 220 and other bodies to a configuration of building blocks. Cord 221 is held in a hook 222*a* which serves as common axis guide. Cord 221 is either threaded through the opening of hook 222*a* or cord 221 is inserted sideways into slot 225*a*, sufficiently stretched to reduce the diameter, and then squeezed under downward pressure through gap 222*b* into hook 222*a*.

The two shells 220*a* and 220*b* are each rotatably mounted on central body 220*c*. In FIG. 22*a* the body shells 220*a* and 220*b* consist of a octagonal ring 224*a* and a frustrum 224*b* of an 8-sided pyramid. The top surface of fustrum 224*b* includes the means for rotatably connecting shell 220*a* to central body 220*c*. When interfacing a building block as shown in FIG. 22 with other building blocks in an assembly shells 220*a* and 220*b* will assume rotational positions in which the surfaces of octagonal rings 224*a* are aligned. There is no restriction in using other shell bodies in place of those shown in FIG. 22 as long as they include equally sized polyhedron rings.

Central body 220*c* includes two short tongues spaced apart to provide a narrow slot 225*b*. Narrow slot 225*b* is aligned with slot 225*a* of the building block. Slot 225*b* can be used to terminate cord 221 in a fashion as shown in FIG. 6.

Central body 220*c* carries at both ends cylindrical bearings 226*a* and 226*b* with grooves 227*a* and 227*b*. Shells 220*a* and 220*b* have corresponding bearing means consisting of a cylindrical opening in the top of fustrum 224*a*. FIG. 22*b* is a view of center body 220*c* and shell 220*a*. Inside the cylindrical opening there is a rind 228*a* protruding into the open space. During assembly of the body this ring 228*a* is slid into groove 227*a* of bearing 226*a*. Shell 220*b* is rotatably mounted on center body 220*c* in the same fashion as shell 220*a*.

Description of Different Block Interfaces

FIGS. 23 through 26 are illustrations of building block interfaces which ensure that adjacent blocks remain in a desired position to each other.

FIG. 23 is an illustration of a cubic building blocks 230 with reinforced edges which prevent rotation and slipping of adjacent blocks. Building block 230 has the same slot arrangement as building block 100 in FIG. 10, two slots with each 2 slot sections, crossing two opposite edges. In FIG. 23 only one slot 231 is visible. All 8 edges of surfaces parallel to slot 231 of building block 230 have each one indented edge section and one protruding section like indented section 232 and protruding section 233 of edge 234 of block 230. All four edges perpendicular to the plane of the slots are indented to receive protruding sections when the interface is rotated by 90°. When blocks with enforced edges are placed in an adjacent positions protruding sections fit into indented sections. Once tension is established in the cord which is threaded through the building blocks, the blocks tend to remain in the configuration established by the user.

FIG. 24 is an illustration of a different interlocking pattern for building blocks. Instead of subdividing an edge into two sections each edge consists of many small protruding zones 240 spaced apart by suitably sized recesses 241 to receive protruding zones of an adjacent building block. The protruding zones and recesses could as well be arranged in circles of different radii around the center of an interface surface.

FIG. 25 is an illustration of a building block interface for preventing rotational and shift movement between adjacent building blocks. The fan type interface consists of an arrangement of substantially triangular planes 250 arranged with a small alternating positive and negative angle to common plane 251 of an interface surface of a building block. Triangular planes 250 extend in radial direction from center 252 in plane 251. Such an arrangement included in the interfacing faces of two adjacent blocks prevents unintentional rotation and shift between the two blocks. In FIG. 25 the fan type interface includes a hole 253 through which the elastic cord can be threaded for assembly with other building blocks. A fan type interface could be combined with a slot end or with a slot passing through the interface surface.

FIG. 26 is an illustration of a building block interface as described with reference to FIG. 25. In FIG. 26 the interface of FIG. 25 is applied to faces smaller than the diameter of the interface. Furthermore, the two interfacing faces 260*a* and 260*b* of two building blocks include slots 261*a* and 261*b*. Slots 261*a* and 261*b* are just opening in the interface pattern and do not interfere with the function of the same.

If there are the same number of pairs of negative and positive angled planes per section, such as a quadrant section, on an interface surface then interfacing surfaces will be aligned at rotational distances of the size of the sections.

FIG. 27 is an illustration of the four components 270*a*, 270*b*, 270*c*, and 270*d* of building block which has two three-sided slots when fully assembled. The two three-sided slots are in planes normal to each other. Body 270*a* is one corner piece of a cubic building block which when fully assembled is similar to the one shown in FIG. 16. The building block of FIG. 27 results from a horizontal cut through the middle of the building block of FIG. 16. The plane of such a cut is normal to the two planes of the two three-sided slots and goes through the four center points of the ends 273*a*, 273*b*, 273*c*, and 273*d* of the two three-sided slots.

All four components of this building block are equal, therefore only component 270*a* will be described in detail. Component 270*a* includes one long side 271*b*, and two short sides 271*a* and 271*c* which are one side of the rims of a three-sided slot. The other long side 272 includes a semicircular recess 273*a* which is one of the terminal ends of the other three-sided slots of the assembled building block. Long side 272 includes two recesses 274*a* and 274*b* symmetrically spaced from recess 273*a* to receive locking tongues of adjacent corner pieces.

The two short sides 271*a* and 271*c* carry locking tongues 276*a* and 276*b* to interlock with recesses 277*a* and 277*b* of adjacent corner pieces 270*c*, respectively 270*d*.

FIG. 29 is an illustration of a disassembled cubic building block with two two-sided slots in a common plane, similar to the building block described with reference to FIG. 19. The two halves of the building block result from a cut in the plane perpendicular to the plane common to the two slots 291*a* and 291*b*. In FIG. 29 upper body 292*a* includes the inner rim 293*a* and lower body 292*b* includes the outer rim 293*b* which allows to assemble building block 290 like a box. Of course there are other ways of keeping block 290 assembled, such as suitably placed tongues and recesses as disclosed with reference to FIG. 27.

FIG. 30*a* is an illustration of another cubic building block which can be disassembled for side threading. The building block of FIG. 30*a* consists of an outer section 300*a* and an inner section 300*b*. Inner section 300*b* is sufficiently smaller than outer section 300*a* to just fit inside outer section 300*a*. Section 300*a* has an open ended single surface slot 301*a* and an open ended dual surface slot 301*b*. Section 300*b* has an open ended single surface slot 302*a* and an open ended dual surface slot 302*b*. Both inner section 300*b* and outer section 300*a* can be used as independent building blocks and offer side threading capability by the open ended slots. Inner section 300*b* can be inserted into outer section 300*a* as indicated in FIG. 30*a*, resulting in a closed building block equivalent to the building block of FIG. 10. However, if one of the two sections is rotated 180 degree so that the open ended single surface slots match and the open ended dual surface slots match then the assembled building block is similar to that of FIG. 15 having a round opening in one surface opposite to a three surface slot.

For easier handling open slot end 303*a* and slot 303*b* of outer section 300*a* can be widened to ease holding inner section 300*b* when disassembling this type of building block. In FIG. 30*a* open slot end 303*a* and slot 303*b* are widened by suitable sized quarter circular sections 309*a*, 309*b*, 309*c*, and 309*d*, respectively. Other cut-out forms may be used to suit other applications.

FIG. 30*b* is an illustration of one section of a cubic building block which provides for side threading. The building block of FIG. 30*b* consists of two equal sized sections 305 which can be put together to make up a closed building block equivalent to the building block of FIG. 10. Section 305 consists of an outer half section 306*a* and an inner half section 306*b*. Outer and inner half sections are sized so that inner half section of one section 305 fits into the outer half section 306*b* of another section 305. In FIG. 30*b* slot 307*a* traverses front face 308*a* of outer half section 306*a* and meets slot end 307*b* of bottom face 308*b*; front face 308*c* of inner half section 306*b* includes slot end 307*c*. Other slot arrangements including slots in the side faces of the two half sections are possible. FIG. 30*c* is an illustration of a building block assembled from two building block sections of the type shown in FIG. 30*b*.

Figure 31:
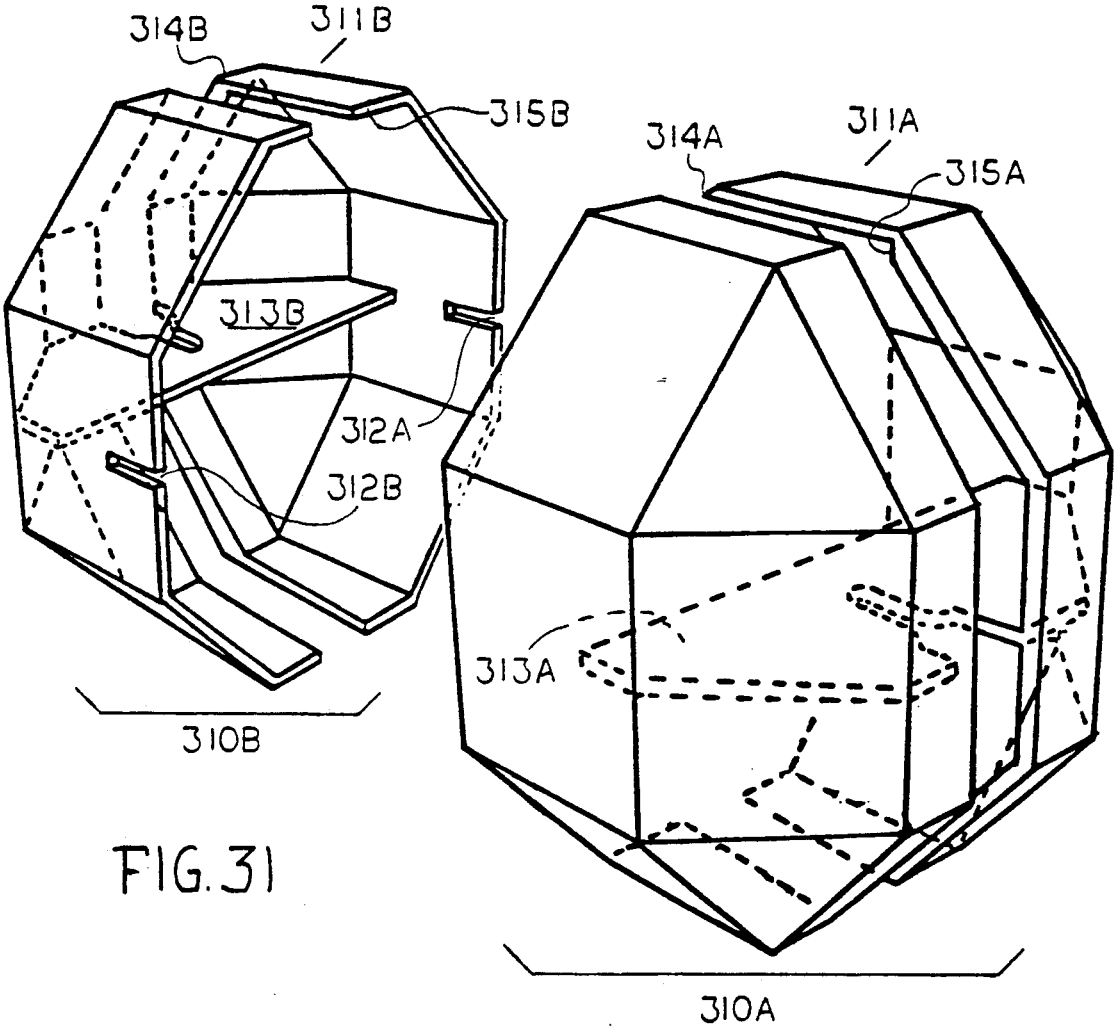

FIG. 31 is an illustration of an octangonal building block which can be disassembled for side threading. The building block of FIG. 31 consists of two portions 310*a* and 310*b* which fit together at overlapping circumferential sections 311*a* and 311*b* to form a building block similar to block 171 with cap portion 172 of FIG. 17. Section 311*a* slips over section 311*b* to a position where edge 314*a* joins edge 314*b* and boarder 315*b* buts against straight element 315*a*. Slots 312*a* and 312*b* of section 311*b* receive board 313*a* to a position where there remains a space between boards 313*a* and 313*b* forming a centering guide opening for a cord threaded through the building block.

As indicated in the description of the various building blocks, there are a number of features shared by several of the building blocks. All of the building blocks are polyhedrons. Flat surfaces are the basic feature to provide a stable interface with an adjacent Building block. Furthermore, the stability of the interface with an adjacent building block is provided by the common axis principle of the design. Slots are used to provide the possibility to change the interfacing surfaces, thereby changing the configuration of an assembly withyout having to disassemble an assembly of building blocks on a core. Four different ways to move adjacent building blocks relarive to each other and the combination of the same are used to change configurations. TABLE 1 correlates the various features of the educational toy of the present invention with the FIGS. 1 through 31.

TABLE 1

| Building Block Classifications | |
|---|---|
| CHARACTERISTIC | FIGURES |
| a) Polyhedron shell | |
| one piece building block | |
| cookie cutter type, open sided | 10, 11, 14, 28 17, 18, 20, 21 |
| contiguous surfaces | 10, 11, 12, 13, 14, 15, 16, 19, 20 |
| divided surfaces | 17, 18, 21, 22 |
| symmetrical in 3 dimensions | 13, 15, 16, 18, 19 |
| two piece building block | |
| cut along slots | 19, 20, 21, 31 |
| cut across slots | 29, 30 |
| four piece building block cut across slots | 27 |
| b) Common axis determined by slot | |
| slot endings in faces only | 10, 11, 12, 13, 19 29, 30 |
| slot endings in faces or opening in opposite face | 15, 16, 27 |
| slot endings in faces or internal guide | 14, 20, 28 |
| internal guide only | 17, 18, 21, 22, 31 |
| hole in face | 11, 15 |
| adjacent block, surface interlock | 12 |
| c) Slot arrangement | |
| Slot length | |
| two face slots | 10, 11, 12, 13, 19, 29, 30 |
| >2 face slots | 14, 15, 16, 20, 31 17, 18, 21 |
| 360 degree slot | 22 |
| Slot relation | |
| single | 10, 13, 14, 16, 19, 20, 27 |
| pairs of 180° slots, overlapping | 17, 18, 21, 31 |
| intersecting ensemble | 15, 18 |
| opposing in common plane | 10, 14, 17, 19, 20, 21, 22, 28, 29, 30, 31 |
| opposing in different planes | 13, 16, 27 |
| opposing in common and different planes | 18 |
| d) relative movement between adjacent building blocks | |
| rotation | 2, 4, 5, 6, 7 |
| pivoting | 4, 5, 7 |
| shifting | 1, 2, 4, 5, 6, 7 |
| rolling | 1, 2, 4, 6, 7 |
| e) locks for preventing unintended movements between adjacent building blocks | |
| edge implementation | 12, 23, 24 |
| face implementation | 25, 26 |
| circular type on face | 24 |
| f) cord termination (cord binding) | |
| cross piece, clothes pin | 9 |
| narrow slot | 6, 17, 18, 21, 31 |
| g) assembly | |
| single cord assembly | 1, 2 |
| multiple cords linked assembly | 3, 4 |
| h) threading methods | |
| serial threading | 5, 6, 7, 10, 11, 12, 13, 14, 15, 16, 17, 18 |
| side threading | |
| divides building block | 8, 19, 20, 21, 27, 29, 30, 31 |
| slit | 28 |

TABLE 1-continued

| Building Block Classifications | |
|---|---|
| CHARACTERISTIC | FIGURES |
| hook | 22 |
| open insertion along single central axis slot | 15, 16, 17, 18, 21, 31 |

While a great number of different building blocks have been described in detail, the above tabular presentation of the features included in the described building block shows that still other building blocks can be designed using different combinations of the listed features without departing from the basics of this invention.

What I claim is:

1. An educational experimenting device using hollow polyhedron building blocks and an elastic cord for stringing said building blocks for building modifiable configurations of threaded building blocks comprising a plurality of groups of building blocks, including a first group of building blocks non-removably stringed on said elastic cord and a second group of building blocks adapted for insertion on said cord between two building blocks by stretching said elastic cord at the location of insertion and releasing said cord after insertion of said building block of said second group, each of said building blocks of said second group including openings in at least two interface surfaces for receiving said elastic cord thereby engaging said building block of said second group with adjacent building blocks of said first group.

2. An educational experimenting device using hollow polyhedron building blocks and an elastic cord for stringing said building blocks for building modifiable configurations of threaded building blocks as claimed in claim 1, wherein said second group of building blocks includes building blocks consisting of two sections, each of said sections having an open face and adjacent surfaces and open-ended slots extending from an edge common to said open face and one of said surfaces to at least one quarter of the diameter of said elastic cord beyond the middle of said surface, said open-ended slots being closed by assembling said sections of said building block.

3. An educational experimenting device using hollow polyhedron building blocks and an elastic cord for stringing said building blocks for building modifiable configurations of threaded building blocks as claimed in claim 1, wherein said second group of building blocks include building blocks having at least one elongated openings extending over a plurality of surfaces including two opposing surfaces of said building blocks.

4. An educational experimenting device for building modifiable configurations of threaded building blocks comprising a plurality of hollow polyhedron building blocks, a stretchable elastic cord for threading a plurality of said building blocks and establishing a first configuration of said threaded building blocks including a first building block, a sequence of building blocks, and a last building block, means for terminating said cord in said first building block means for terminating said cord in said last building block each of said building blocks having
surfaces for interfacing with adjacently threaded building blocks, said surfaces including openings for receiving said cord,
said openings including at least one elongated opening extending over at least two contiguous ones of said surfaces, and
cord guiding means for establishing a common axis of a first relative position with an adjacent building blocks on said cord.
said building blocks further include building blocks having centering means for guiding said cord through the center of said building blocks,
wherein said cord guiding means being provided by said centering means,
wherein said centering means include a hook for receiving said cord, and
wherein said cord guiding means being established by sliding said cord behind said hook.

5. An educational experimenting device for building modifiable configurations of threaded building blocks comprising
a plurality of hollow polyhedron building blocks,
a stretchable elastic cord for threading a plurality of said building blocks and establishing a first configuration of said threaded building blocks including a first building block, a sequence of building blocks, and a last building block,
means for terminating said cord in said first building block, means for terminating said cord in said last building block,
each of said building blocks having
surfaces for interfacing with adjacently threaded building blocks, said surfaces including openings for receiving said cord,
said openings including at least one elongated opening extending over at least two contiguous ones of said surfaces, and
cord guiding means for establishing a common axis of a first relative position with an adjacent building blocks on said cord;
said building blocks include building blocks having
a central axis section with a first and a second end, and two half shells mounted spaced apart on said first and said second end of said central axis section in opposite direction thereby forming a polyhedron building block,
each of said half shells providing partial interface surfaces of said blocks,
pairs of said partial interface surfaces of said two shells constituting said surfaces for interfacing with adjacently threaded building blocks,
said space between said two half shells constituting said opening for receiving said cord.

6. An educational experimenting device for building modifiable configurations of threaded building blocks as claimed in claim 5, wherein
said central axis section includes centering means for guiding said cord through said center of said building block,
wherein said guiding means being established by said cord passing through said centering means.

7. An educational experimenting device for building modifiable configurations of threaded building blocks as claimed in claim 6, wherein
said central axis section includes centering means for guiding said cord through said center of said building block,
said centering means include a hook for receiving said cord, wherein said guiding means are established by sliding said cord behind said hook.

8. An educational experimenting device for building modifiable configurations of threaded building blocks comprising
building blocks from a plurality of classes of hollow polyhedron building blocks,
an elastic cord for threading a plurality of said building blocks from said plurality of classes of building blocks for establishing an assembly of threaded building blocks including a first building block, a sequence of building blocks, and a last building block,
means for terminating said cord in said first building block,
means for terminating said cord in said last building block,
said assembly of threaded building blocks constituting a first configuration of threaded building blocks; each of said building blocks having
surfaces for interfacing with adjacently threaded building blocks and associated with said interface surfaces elongated openings for receiving said elastic cord;
cord guiding means for establishing a common axis for a relative position with an adjacent building blocks,
said elastic cord when stretched between adjacent ones of said building blocks providing space for changing a first relative position between said adjacent building blocks with a first common axis to a second relative position with a different common axis forming a second configuration of said assembly of threaded building blocks;
said building blocks including building blocks consisting of two equal polyhedron rings each having at least three surfaces, and a center board
said rings being co-axially arranged with associated surfaces being in the same plane, and spaced apart providing a circumferential opening for receiving said cord,
said center board radially spanning the space inside said rings between two associated pairs of surfaces of said polyhedral rings,
said center board having a first opening for receiving said cord.
said associated surfaces providing for selectively interfacing with adjacent building blocks.

9. An educational experimenting device for building modifiable configurations of threaded building blocks comprising
building blocks from a plurality of classes of hollow polyhedron building blocks,
an elastic cord for threading a plurality of said building blocks from said plurality of classes of building blocks for establishing an assembly of threaded building blocks including a first building block, a sequence of building blocks, and a last building block,
means for terminating said cord in said first building block, means for terminating said cord in said last building block,
said assembly of threaded building blocks constituting a first configuration of threaded building blocks;
each of said building blocks having surfaces for interfacing with adjacently threaded building blocks and associated with said interface surfaces elongated openings for receiving said elastic cord;

cord guiding means for establishing a common axis for a relative position with an adjacent building blocks, said elastic cord when stretched between adjacent ones of said building blocks providing space for changing a first relative position between said adjacent building blocks with a first common axis to a second relative position with a different common axis thereby forming a second configuration of said assembly of threaded building blocks;

said building blocks includes building blocks having at least one center board radially spanning the space inside said building blocks, and at least one elongated opening associated with at least three contiguous interface surfaces for selectively interfacing with adjacent building blocks, said center board including a first opening for threading said cord through said building block.

10. An educational experimenting device for building modifiable configurations of threaded building blocks as claimed in claim 9, wherein said center board including second and third openings aligned with said elongated openings in said interface surfaces and with said first opening and extending from the ends of said center board towards said first opening.

11. An educational experimenting device for building modifiable configurations of threaded building blocks as claimed in claim 10, said center board further including fourth and fifth openings for terminating said cord said fourth and fifth openings being aligned with said first opening, said second and third openings, and openings in said interface surfaces, extending from said second and third openings towards said first opening and having a smaller width than said second and third openings.

12. An educational experimenting device using hollow polyhedron building blocks and an elastic cord for stringing said building blocks for building modifiable configurations of threaded building blocks comprising a plurality of different types of building blocks, each of said building blocks including openings in at least two interface surfaces for interfacing with adjacently stringed building blocks, said openings include at least one pair of elongated openings in adjacent ones of said interface surfaces extending from the center of the common edge of said adjacent interface surfaces through the center of said interface surfaces, said elongated openings providing for the modifiability of said configuration;

said plurality of types of building including a type of polyhedron building blocks comprising a plurality of interface surfaces including a plurality of first interface surfaces having an opening extending from the center of the common edge with an adjacent one of said interface surfaces to about a quarter of the width of said opening beyond the center of said interface surfaces, and a second interface surface having a first opening extending from the center of a first edge of said second interface surface to the center of a second edge opposing said first edge, and a second opening extending from the center of a third edge of said second interface surface to the center of a fourth edge opposing said third edge, said first and second interface surfaces being arranged in pairs of first interface surfaces meeting with opposing edges of said second interface surface and having the associated openings aligned; and a third interface surface having a center opening.

13. An educational experimenting device using hollow polyhedron building blocks and an elastic cord for stringing said building blocks for building modifiable configurations of threaded building blocks comprising a plurality of different types of building blocks, each of said building blocks including openings in at least two interface surfaces for interfacing with adjacently stringed building blocks, said openings include at least one pair of elongated openings in adjacent ones of said interface surfaces extending from the center of the common edge of said adjacent interface surfaces through the center of said interface surfaces, said elongated openings providing for the modifiability of said configuration;

said plurality of types of building including a type of a three-dimensional polyhedron building block comprising a plurality of said interface surfaces and at least one open-sided interface, said open-sided interface having edges including means for holding an equally sized interface surface of another adjacently stringed building block in position.

14. An educational experimenting device using building blocks and an elastic cord for stringing said building blocks for building modifiable configurations comprising polyhedron building blocks having surfaces for interfacing with adjacent polyhedron building blocks and means for centering interfacing surfaces said centering means including elongated openings;

each of said elongated openings extending over at least two adjacent surfaces of said building block for guiding said cord and establishing a common axis for said building block and an adjacent building block; said surfaces sharing the same elongated opening providing selective choices for interfacing said building block with a surface of said adjacent building block surfaces of said building block thereby allowing to change the configuration of a threaded sequence of building blocks without removing one of said building blocks from said cord;

said building blocks include building blocks having a central axis section with a first and a second end, and rotatably mounted on said first and said second end spaced apart and in opposing direction two half shells spaced thereby forming a polyhedron building block, each of said half shells providing a plurality of partial interface surfaces of said building blocks, pairs of said partial interface surfaces of said two shells constituting said surfaces for interfacing with adjacently threaded building blocks, said space between said two half shells constituting said opening for receiving said cord, said rotatable shells providing a 360° elongated opening.

15. An educational experimenting device for building modifiable configurations of threaded building blocks comprising building blocks from a plurality of classes of hollow polyhedron building blocks, an elastic cord for threading a plurality of said building blocks from said plurality of classes of building blocks for establishing an assembly of threaded building blocks including a first building block, a sequence of building blocks, and a last building block, means for terminating said cord in said first building block, means for terminating said cord in said last building block, said assembly of threaded building blocks constituting a first configuration of threaded building blocks;

each of said building blocks having surfaces for interfacing with adjacently threaded building blocks and associated with said interface surfaces elongated openings for receiving said elastic cord;

cord guiding means for establishing a common axis for a relative position with an adjacent building blocks, said elastic cord when stretched between adjacent ones of said building blocks providing space for changing a first relative position between said adjacent building blocks with a first common axis to a second relative position with a different common axis thereby forming a second configuration of said assembly of threaded building blocks;

said building blocks including building blocks consists of a first block section and a second block section, each of said block sections having an open face, a plurality of interface surfaces, a first opening and a second opening in said interface surfaces, said interface surfaces and said open face being perpendicular to a central plane of said building block, said first opening extending from the center of a first common edge of said open face with a first interface surface to at least a quarter of a diameter of said cord beyond the center of said first interface surface, said second opening extending over two contiguous interface surfaces from the center of a second common edge of said open face with a second interface surface through the center of a third common edge of said second interface surface with a third interface surface to at least a quarter of a diameter of said cord beyond the center of said third interface surfaces associated with said third common edge, said first and said second common edges opposing each other in the plane of said open face, the centers of said first and said second openings being in said center plane, and wherein said second block section is sized to fit inside said first block section.

16. An educational experimenting device for building modifiable configurations of threaded building blocks as claimed in claim 15, wherein said second block section selectively fitting into said first block section in at least two positions, thereby providing at least two different building block configurations.

17. An educational experimenting device for building modifiable configurations of threaded building blocks as claimed in claim 15, wherein said first and said second block sections are of equal shape, each providing a partial outer section and a partial inner section of said two-sectional building block.

18. An educational experimenting device for building modifiable configurations of threaded building blocks comprising building blocks from a plurality of classes of hollow polyhedron building blocks, an elastic cord for threading a plurality of said building blocks from said plurality of classes of building blocks for establishing an assembly of threaded building blocks including a first building block, a sequence of building blocks, and a last building block, means for terminating said cord in said first building block, means for terminating said cord in said last building block, said assembly of threaded building blocks constituting a first configuration of threaded building blocks;

each of said building blocks having surfaces for interfacing with adjacently threaded building blocks and associated with said interface surfaces elongated openings for receiving said elastic cord;

cord guiding means for establishing a common axis for a relative position with an adjacent building blocks, said elastic cord when stretched between adjacent ones of said building blocks providing space for changing a first relative position between said adjacent building blocks with a first common axis to a second relative position with a different common axis thereby forming a second configuration of said assembly of threaded building blocks;

said building blocks including building blocks consists of a two half block sections, each of said block sections constituting a half of a cubic building block, each of said block sections including an open face, four half interface surfaces and an full interface surface, a first interface surfaces including a semicircle constituting the end of an elongated opening beyond the center of an interface surface of the assembled building block, a second half interface surface and said full interface surface including an elongated opening beginning at the center of the common edge of said second half interface surface with said open face, extending to the center of the common edge of said second half interface surface with said full interface surface to a quarter of the diameter of said cord beyond the center of said full interface surface, said four half interface surfaces including means for linking said two half block sections.

19. An educational experimenting device for building modifiable configurations of threaded building blocks comprising building blocks from a plurality of class of hollow polyhedron building blocks, an elastic cord for threading a plurality of said building blocks from said plurality of classes of building blocks for establishing an assembly of threaded building blocks including a first building block, a sequence of building blocks, and a last building block, means for terminating said cord in said first building block, means for terminating said cord in said last building block, said assembly of threaded building blocks constituting a first configuration of threaded building blocks;

each of said building blocks having surfaces for interfacing with adjacently threaded building blocks and associated with said interface surfaces elongated openings for receiving said elastic cord;

cord guiding means for establishing a common axis for a relative position with an adjacent building blocks, said elastic cord when stretched between adjacent ones of said building blocks providing space for changing a first relative position between said adjacent building blocks with a first common axis to a second relative position with a different common axis thereby forming a second configuration of said assembly of threaded building blocks;

said building blocks including building blocks consists of a four block sections, each of said block sections constituting a quarter of a cubic building block, each of said block sections including two open faces, two side faces and a first and a second long face, said first long face including a semicircle constituting the end of an elongated opening beyond the center of an interface surface of the assembled building block, and two locking recesses for receiving locking tongues of an adjacent section of said assembled building block, said side faces including said locking tonques for interlocking with said locking recesses, said assembled building block having elongated openings between said interlocked sections aligned with said semi-circles.

20. An educational experimenting device for building modifiable configurations of threaded building blocks comprising building blocks from a plurality of classes of hollow polyhedron building blocks, an elastic cord for threading a plurality of said building blocks from said plurality of classes of building blocks for establishing an assembly of threaded building blocks including a first building block, a sequence of building blocks, and a last building block, means for terminating said cord in said first building block, means for terminating said cord in said last building block, said assembly of threaded building blocks constituting a first configuration of threaded building blocks;

each of said building blocks having surfaces for interfacing with adjacently threaded building blocks and associated with said interface surfaces elongated openings for receiving said elastic cord;

cord guiding means for establishing a common axis for a relative position with an adjacent building blocks, said elastic cord when stretched between adjacent ones of said building blocks providing space for changing a first relative position between said adjacent building blocks with a first common axis to a second relative position with a different common axis thereby forming a second configuration of said assembly of threaded building blocks;

said building blocks including building blocks consists of a two block sections, each having an open face, a plurality of interface surfaces, a first opening and a second opening in said interface surfaces, said interface surfaces and said open face being perpendicular to a central plane of said building block, said first opening extending from the center of a first common edge of said open face with a first interface surface to at least a quarter of a diameter of said cord beyond the center of said first interface surface, said second opening extending over two contiguous interface surfaces from the center of a second common edge of said open face with a second interface surface through the center of a third common edge of said second interface surface with a third interface surface to at least a quarter of a diameter of said cord beyond the center of said third interface surfaces associated with said third common edge, said first and said second common edges opposing each other in the plane of said open face, the centers of said first and said second openings being in said center plane, and wherein said second block section is sized to fit inside said first block section.

21. An educational experimenting device using building blocks and an elastic cord for stringing said building blocks for building modifiable configurations of threaded building blocks comprising building blocks from a plurality of classes of hollow polyhedron building blocks, an elastic cord for threading a plurality of said building blocks from said plurality of classes of building blocks for establishing an assembly of threaded building blocks including a first building block, a sequence of building blocks, and a last building block, means for terminating said cord in said first building block, means for terminating said cord in said last building block, said assembly of threaded building blocks constituting a first configuration of threaded building blocks;

each of said building blocks having surfaces for interfacing with adjacently threaded building blocks and associated with said interface surfaces elongated openings for receiving said elastic cord;

cord guiding means for establishing a common axis for a relative position with an adjacent building blocks, said elastic cord when stretched between adjacent ones of said building blocks providing space for changing a first relative position between said adjacent building blocks with a first common axis to a second relative position with a different common axis thereby forming a second configuration of said assembly of threaded building blocks;

said polyhedron building blocks having surfaces for interfacing with adjacently stringed building blocks;

said surfaces including locking means for preventing rotation between adjacent building blocks;

said locking means include circular arrangements of substantially triangular planes alternatingly angled relative to the plane of said surface thereby providing radially directed protrusions and recesses in said surfaces;

whereby protrusion and recesses of a surface of one building block match with those of a surface of an adjacently stringed building block.

22. An educational device for users experimenting with modifiable stringable building blocks comprising an stretchable elastic cord having a first and a second end;

a plurality of polyhedron hollow building blocks of different shapes each having at least a first opening and a second opening, and means for securing said first and said second end of said cord to terminal building blocks of an assembly of building blocks; said assembly of building blocks being user assembled by stringing said elastic cord through said first and said second openings of a first terminal building block, a series of other building blocks and a last terminal building block, and securing under tension said first and second ends of said cord to said first and said last terminal building blocks;

wherein a first and a second assembly of building blocks are user interlocked by stretching said cord of said first assembly of building blocks between two selected ones of said building blocks providing an exposed section of said cord, and wherein said exposed cord being inserted between two selected building blocks of said second assembly of building blocks into an elongated opening of one of said two selected building blocks of said second assembly of building blocks.

23. An educational device for users experimenting with modifiable stringable building blocks comprising an stretchable elastic cord having a first and a second end; a plurality of polyhedron hollow building blocks of different shapes each having at least a first opening and a second opening, and means for securing said first and said second end of said cord to terminal building blocks of an assembly of building blocks; said assembly of building blocks being user assembled by stringing said elastic cord through said first and said second openings of a first terminal building block, a series of other building blocks and a last terminal building block, and securing under tension said first and second ends of said cord to said first and said last terminal building blocks;

wherein a first section of said assembly of building blocks and a second section of said assembly of building blocks are user interlocked to form a loop of stringed building blocks, said cord of said assembly of building blocks being stretched between two first building blocks thereby exposing a section of said cord, said exposed cord being inserted between two selected second building blocks of said assembly of building blocks and into an elongated opening of one of said two selected second building blocks.

* * * * *